US009825393B1

(12) United States Patent
Vino, IV et al.

(10) Patent No.: US 9,825,393 B1
(45) Date of Patent: Nov. 21, 2017

(54) ELECTRICAL CONTACT HAVING CONTACT SURFACES IN TWO PLANES PERPENDICULAR TO EACH OTHER

(71) Applicant: TE CONNECTIVITY CORPORATION, Berwyn, PA (US)

(72) Inventors: Michael Joseph Vino, IV, Landisville, PA (US); Chad William Morgan, Carneys Point, NJ (US); Craig Warren Hornung, Harrisburg, PA (US); Justin Dennis Pickel, Hummelstown, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/416,378

(22) Filed: Jan. 26, 2017

(51) Int. Cl.
*H01R 24/00* (2011.01)
*H01R 33/00* (2006.01)
*H01R 13/11* (2006.01)

(52) U.S. Cl.
CPC ..... *H01R 13/114* (2013.01); *H01R 23/02* (2013.01)

(58) Field of Classification Search
CPC ..... H01R 12/716; H01R 13/04; H01R 13/11; H01R 13/17; H01R 13/114; H01R 13/187; H01R 24/00; H01R 24/60; H01R 24/62; H01R 24/76; H01R 23/02; H01R 33/00
USPC ..... 439/80, 660, 682, 862
See application file for complete search history.

(56) References Cited

U.S. PATENT DOCUMENTS

| | | | | |
|---|---|---|---|---|
| 4,973,273 | A * | 11/1990 | DePriest | H01R 13/11 439/856 |
| 7,192,320 | B2 | 3/2007 | Yasumura et al. | |
| 8,287,322 | B2 | 10/2012 | Jeon | |
| 8,512,081 | B2 | 8/2013 | Stokoe | |
| 8,550,861 | B2 | 10/2013 | Cohen et al. | |
| 2011/0021058 | A1* | 1/2011 | Todo | H01R 13/62911 439/345 |
| 2013/0273756 | A1* | 10/2013 | Stoner | H01R 13/658 439/108 |
| 2014/0057498 | A1 | 2/2014 | Cohen | |

FOREIGN PATENT DOCUMENTS

CN 202019074 U 10/2011

* cited by examiner

*Primary Examiner* — Chandrika Prasad

(57) ABSTRACT

An electrical contact is provided. The electrical contact includes a mating segment configured to engage another contact. The mating segment extends a length to a contact end of the mating segment. The mating segment includes a first mating zone that is located a distance from the contact end along the length of the mating segment. The first mating zone is configured to intimately engage the other contact in a first plane for electrical communication between the electrical contact and the other contact. The mating segment includes a second mating zone that is offset from the first mating zone along the length of the mating segment in a direction toward the contact end. The second mating zone is configured to intimately engage the other contact in a second plane that extends approximately perpendicular to the first plane for electrical communication between the electrical contact and the other contact.

20 Claims, 10 Drawing Sheets

ELECTRICAL CONTACT HAVING CONTACT SURFACES IN TWO PLANES PERPENDICULAR TO EACH OTHER

BACKGROUND

The subject matter herein relates generally to electrical contacts having stub portions that generate an electrical resonance during operation.

Electrical connectors are used to transmit data in various industries. The electrical connectors are often configured to repeatedly engage and disengage complementary electrical connectors. The process of mating the electrical connectors may be referred to as a mating operation. For example, in a backplane communication system, a backplane circuit board has a header connector that is configured to mate with a receptacle connector. The receptacle connector is typically mounted to a daughter card. The header connector includes an array of electrical contacts (hereinafter referred to as "header contacts"), and the receptacle connector includes a complementary array of electrical contacts (hereinafter referred to as "receptacle contacts"). During the mating operation, the receptacle contacts mechanically engage and slide along the corresponding header contacts. The sliding engagement between the receptacle and header contacts may be referred to as a wiping action, because each receptacle contact wipes along a contact surface of the corresponding header contact.

During this wiping action, each receptacle contact typically slides from a contact end of the corresponding header contact toward a mating zone along the header contact. The mating zone is a distance away from the contact end of the header contact. The portion of the header contact that extends between the contact end and the mating zone is referred to as a stub portion. During operation of the system, energy propagates from the mating zone to the contact end of the header contact where the energy is then reflected back toward the mating zone. At current transmission speeds the reflected energy may resonate, such that the stub portion acts as an antenna that enables electromagnetic radiation to permeate the interface between the mated header and receptacle contacts. Shielding may be required to contain such electromagnetic interference (EMI) radiated by stub portions acting as antennas, which may be costly and thereby increase the cost of manufacturing the connectors.

Accordingly, a need remains for electrical contacts that reduce the unwanted effects of reflected energy along stub portions of the electrical contacts.

BRIEF DESCRIPTION

In an embodiment, an electrical contact includes a mating segment configured to engage another contact. The mating segment extends a length to a contact end of the mating segment. The mating segment includes a first mating zone that is located a distance from the contact end along the length of the mating segment. The first mating zone is configured to intimately engage the other contact in a first plane for electrical communication between the electrical contact and the other contact. The mating segment includes a second mating zone that is offset from the first mating zone along the length of the mating segment in a direction toward the contact end. The second mating zone is configured to intimately engage the other contact in a second plane that extends approximately perpendicular to the first plane for electrical communication between the electrical contact and the other contact.

In an embodiment, an electrical contact includes a mating segment configured to engage another contact. The mating segment extends a length to a contact end of the mating segment. The mating segment includes a base and a first mating zone located a distance from the contact end along the length of the mating segment. The first mating zone is configured to intimately engage the other contact in a first plane for electrical communication between the electrical contact and the other contact. A spring finger extends outward from the base and defining at least a portion of the contact end of the mating segment. The spring finger includes a second mating zone that is located approximately at the contact end such that the second mating zone is offset from the first mating zone along the length of the mating segment. The second mating zone is configured to intimately engage the other contact in a second plane that extends approximately perpendicular to the first plane for electrical communication between the electrical contact and the other contact.

In an embodiment, an electrical connector includes a connector housing configured to engage another connector, and a contact array including a plurality of electrical contacts coupled to the connector housing. Each of the electrical contacts includes a contact body having a mating segment and a base segment. The base segment is coupled to the connector housing. The mating segment is configured to engage another contact of the other connector. The mating segment extends a length to a contact end of the mating segment. The mating segment includes a first mating zone that is located a distance from the contact end along the length of the mating segment. The first mating zone is configured to intimately engage the other contact in a first plane for electrical communication between the electrical contact and the other contact. The mating segment includes a second mating zone that is offset from the first mating zone along the length of the mating segment in a direction toward the contact end. The second mating zone is configured to intimately engage the other contact in a second plane that extends approximately perpendicular to the first plane for electrical communication between the electrical contact and the other contact.

DETAILED DESCRIPTION

Figure 1:
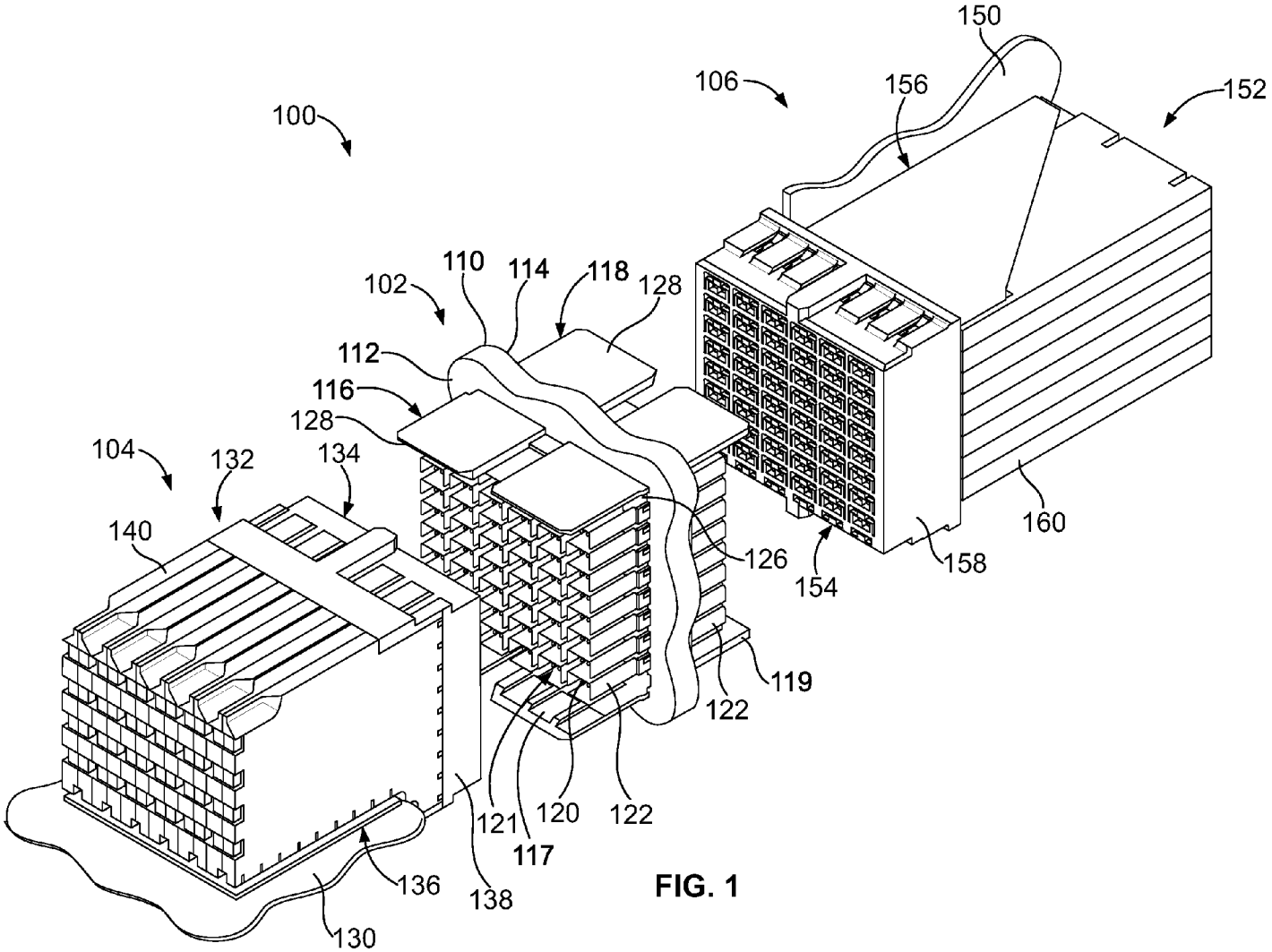
FIG. 1 is a front perspective view of a communication system formed in accordance with an embodiment.

Embodiments set forth herein may include electrical contacts, electrical connectors having the electrical contacts, and communication systems having the electrical connectors. Embodiments may be configured to improve electrical performance, for example, by reducing or eliminating the length of stub portions of electrical contacts. The electrical contacts may form signal paths in which data signals are transmitted through the electrical contacts. Alternatively, the electrical contacts may form ground conductors in which each ground conductor shields adjacent signal paths from one another and provides a return path.

In some embodiments, the electrical connectors are configured to mate with other electrical connectors during a mating operation. During the mating operation, a first electrical contact of one connector may engage and slide (or wipe) along a second electrical contact of the other connector. The second electrical contact may include, among other things, a wipe runway that leads to the mating zone. The first electrical contact slides along the wipe runway of the second electrical contact and operably engages the second electrical contact at the mating zone.

Although the illustrated embodiment includes electrical connectors that are used in high-speed communication systems, such as, but not limited to, backplane or midplane communication systems, it should be understood that embodiments may be used in other communication systems and/or in other systems/devices that utilize electrical contacts having stub portions. It should also be understood that embodiments do not require a wiping action between two electrical contacts. Accordingly, the inventive subject matter is not limited to the illustrated embodiment.

In particular embodiments, the electrical contacts provide signal pathways for transmitting data signals. Embodiments may be particularly suitable for communication systems, such as, but not limited to, network systems, servers, data centers, and/or the like, in which the data rates may be greater than ten (10) gigabits/second (Gbps) or greater than five (5) gigahertz (GHz). One or more embodiments may be configured to transmit data at a rate of at least 20 Gbps, at least 40 Gbps, at least 56 Gbps, or more. One or more embodiments may be configured to transmit data at a frequency of at least 10 GHz, at least 20 GHz, at least 28 GHz, or more. As used herein with respect to data transfer, the term "configured to" does not mean mere capability in a hypothetical or theoretical sense, but means that the embodiment is designed to transmit data at the designated rate or frequency for an extended period of time (e.g., expected time periods for commercial use) and at a signal quality that is sufficient for its intended commercial use. It is contemplated, however, that other embodiments may be configured to operate at data rates that are less than 10 Gbps or operate at frequencies that are less than 5 GHz.

Various embodiments may be configured for certain applications. One or more embodiments may be configured for backplane or midplane communication systems. For example, one or more of the electrical connectors described herein may be similar to electrical connectors of the STRADA Whisper or Z-PACK TinMan product lines developed by TE Connectivity. The electrical connectors may include high-density arrays of electrical contacts. A high-density array may have, for example, at least 12 signal contacts per 100 $mm^2$ along the mating side or the mounting side of the electrical connector. In more particular embodiments, the high-density array may have at least 20 signal contacts per 100 $mm^2$.

Non-limiting examples of some applications that may use embodiments set forth herein include host bus adapters (HBAs), redundant arrays of inexpensive disks (RAIDs), workstations, servers, storage racks, high performance computers, or switches. Embodiments may also include electrical connectors that are small-form factor connectors. For example, the electrical connectors may be configured to be compliant with certain standards, such as, but not limited to, the small-form factor pluggable (SFP) standard, enhanced SFP (SFP+) standard, quad SFP (QSFP) standard, C form-factor pluggable (CFP) standard, and 10 Gigabit SFP standard, which is often referred to as the XFP standard.

To reduce unwanted effects of reflected energy along stub portions of electrical contacts, embodiments described and/or illustrated herein include electrical contacts that do not include stub portions or that have stub portions that are reduced in length (for example as compared to at least some known electrical contacts). The embodiments described and/or illustrated herein may reduce the amount of energy that is resonated from a stub portion such that less electromagnetic radiation permeates the interface between the mated electrical contacts, which may, for example, reduce electromagnetic interference (EMI) such as, but not limited to, crosstalk and/or the like. In some embodiments, the length of the stub portion is reduced by an amount (or the stub portion is eliminated) that prevents the stub portion from acting as an antenna. The embodiments described and/or illustrated herein may require less electromagnetic shielding, which may reduce the cost of manufacturing an electrical connector system.

Electrical contacts described herein may include a plurality of different materials. For example, an electrical contact may include a base material, such as, but not limited to, copper or copper alloy (e.g., beryllium copper), that is plated or coated with one or more other materials. As used herein, when another material is "plated over" or "coated over" a base material, the other material may directly contact or bond to an outer surface of the base material or may directly contact or bond to an outer surface of an intervening material. More specifically, the other material is not required to be directly adjacent to the base material and may be separated by an intervening layer.

Different materials of an electrical contact may be selected to impede electrical resonance along any stub portions. For example, one or more of the materials used in the electrical contacts may be ferromagnetic. More specifically, one or more materials may have a higher relative magnetic permeability. In particular embodiments, the electrical contact includes a material that has a permeability that is, for example, greater than 50. In some embodiments, the permeability is greater than 75 or, more specifically, greater than 100. In certain embodiments, the permeability is greater than 150 or, more specifically, greater than 200. In particular embodiments, the permeability is greater than 250, greater than 350, greater than 450, greater than 550, or more. Non-limiting examples of such materials include nickel, carbon steel, ferrite (nickel zinc or manganese zinc), cobalt, martensitic stainless steel, ferritic stainless steel, iron, alloys of the same, and/or the like. In some embodiments, the material is a martensitic stainless steel (annealed). Materials that have a higher permeability provide a higher internal self-inductance. High permeability may also cause shallow skin depths, which may increase the effective resistance of the electrical contact within a predetermined frequency band.

As used herein, phrases such as "a plurality of [elements]" and "an array of [elements]" and/or the like, when used in the detailed description and claims, do not necessarily include each and every element that a component may have. The component may have other elements that are similar to the plurality of elements. For example, the phrase "a plurality of electrical contacts [being/having a recited feature]" does not necessarily mean that each and every electrical contact of the component has the recited feature. Other electrical contacts may not include the recited feature. Accordingly, unless explicitly stated otherwise (e.g., "each and every electrical contact of the electrical connector [being/having a recited feature]"), embodiments may include similar elements that do not have the recited features.

In order to distinguish similar elements in the detailed description and claims, various labels may be used. For example, an electrical connector may be referred to as a header connector, a receptacle connector, and/o=or a mating connector. Electrical contacts may be referred to as header contacts, receptacle contacts, and/or mating contacts. When similar elements are labeled differently (e.g., receptacle contacts and mating contacts), the different labels do not necessarily require structural differences.

FIG. 1 is a perspective view of a communication system 100 formed in accordance with an embodiment. The communication system 100 is an electrical connector system. In particular embodiments, the communication system 100 may be a backplane or midplane communication system. The communication system 100 includes a circuit board assembly 102, a first connector system (or assembly) 104 configured to be coupled to one side of the circuit board assembly 102, and a second connector system (or assembly) 106 configured to be coupled to an opposite side the circuit board assembly 102. The circuit board assembly 102 is used to electrically connect the first and second connector systems 104, 106. Optionally, either of the first and second connector systems 104, 106 may be part of a line card assembly or a switch card assembly. Although the communication system 100 is configured to interconnect two connector systems in the illustrated embodiment, other communication systems may interconnect more than two connector systems or, alternatively, interconnect a single connector system to another communication device.

The circuit board assembly 102 includes a circuit board 110 having a first board side 112 and second board side 114. In some embodiments, the circuit board 110 may be a backplane circuit board, a midplane circuit board, or a motherboard. The circuit board assembly 102 includes a first header connector 116 mounted to and extending from the first board side 112 of the circuit board 110. The circuit board assembly 102 also includes a second header connector 118 mounted to and extending from the second board side 114 of the circuit board 110. The first and second header connectors 116, 118 include connector housings 117, 119, respectively. The first and second header connectors 116, 118 also include corresponding electrical contacts 120 that are electrically connected to one another through the circuit board 110. The electrical contacts 120 are hereinafter referred to as header contacts 120.

The circuit board assembly 102 includes a plurality of signal paths therethrough defined by the header contacts 120 and conductive vias 170 (shown in FIG. 2) that extend through the circuit board 110. The header contacts 120 of the first and second header connectors 116, 118 may be received in the same conductive vias 170 to define a signal path directly through the circuit board 110. In an exemplary embodiment, the signal paths pass straight through the circuit board assembly 102 in a linear manner. Alternatively, the header contacts 120 of the first header connector 116 and the header contacts 120 of the second header connector 118 may be inserted into different conductive vias 170 that are electrically coupled to one another through traces (not shown) of the circuit board 110.

The first and second header connectors 116, 118 include ground shields or contacts 122 that provide electrical shielding around corresponding header contacts 120. In an exemplary embodiment, the header contacts 120 are arranged in signal pairs 121 and are configured to convey differential signals. Each of the ground shields 122 may peripherally surround a corresponding signal pair 121. As shown, the ground shields 122 are C-shaped or U-shaped and cover the corresponding signal pair 121 along three sides.

The connector housings 117, 119 couple to and hold the header contacts 120 and the ground shields 122 in designated positions relative to each other. The connector housings 117, 119 may be manufactured from a dielectric material, such as, but not limited to, a plastic material. Each of the connector housings 117, 119 includes a mounting wall 126 that is configured to be mounted to the circuit board 110, and shroud walls 128 that extend from the mounting wall 126. The shroud walls 128 cover portions of the header contacts 120 and the ground shields 122.

The first connector system 104 includes a first circuit board 130 and a first receptacle connector 132 that is mounted to the first circuit board 130. The first receptacle connector 132 is configured to be coupled to the first header connector 116 of the circuit board assembly 102 during a mating operation. The first receptacle connector 132 has a mating interface 134 that is configured to be mated with the first header connector 116. The first receptacle connector 132 has a board interface 136 configured to be mated with the first circuit board 130. In an exemplary embodiment, the board interface 136 is oriented perpendicular to the mating interface 134. When the first receptacle connector 132 is coupled to the first header connector 116, the first circuit board 130 is oriented perpendicular to the circuit board 110.

The first receptacle connector 132 includes a front housing or shroud 138. The front housing 138 is configured to hold a plurality of contact modules 140 side-by-side. As shown, the contact modules 140 are held in a stacked configuration generally parallel to one another. In some embodiments, the contact modules 140 hold a plurality of electrical contacts 142 (FIG. 3) that are electrically connected to the first circuit board 130. The electrical contacts 142 are hereinafter referred to as receptacle contacts 142. The receptacle contacts 142 are configured to be electrically connected to the header contacts 120 of the first header connector 116.

The second connector system 106 includes a second circuit board 150 and a second receptacle connector 152 coupled to the second circuit board 150. The second receptacle connector 152 is configured to be coupled to the second header connector 118 during a mating operation. The second receptacle connector 152 has a mating interface 154 configured to be mated with the second header connector 118. The second receptacle connector 152 has a board interface 156 configured to be mated with the second circuit board 150. In an exemplary embodiment, the board interface 156 is oriented perpendicular to the mating interface 154. When the second receptacle connector 152 is coupled to the second header connector 118, the second circuit board 150 is oriented perpendicular to the circuit board 110.

Figure 3:
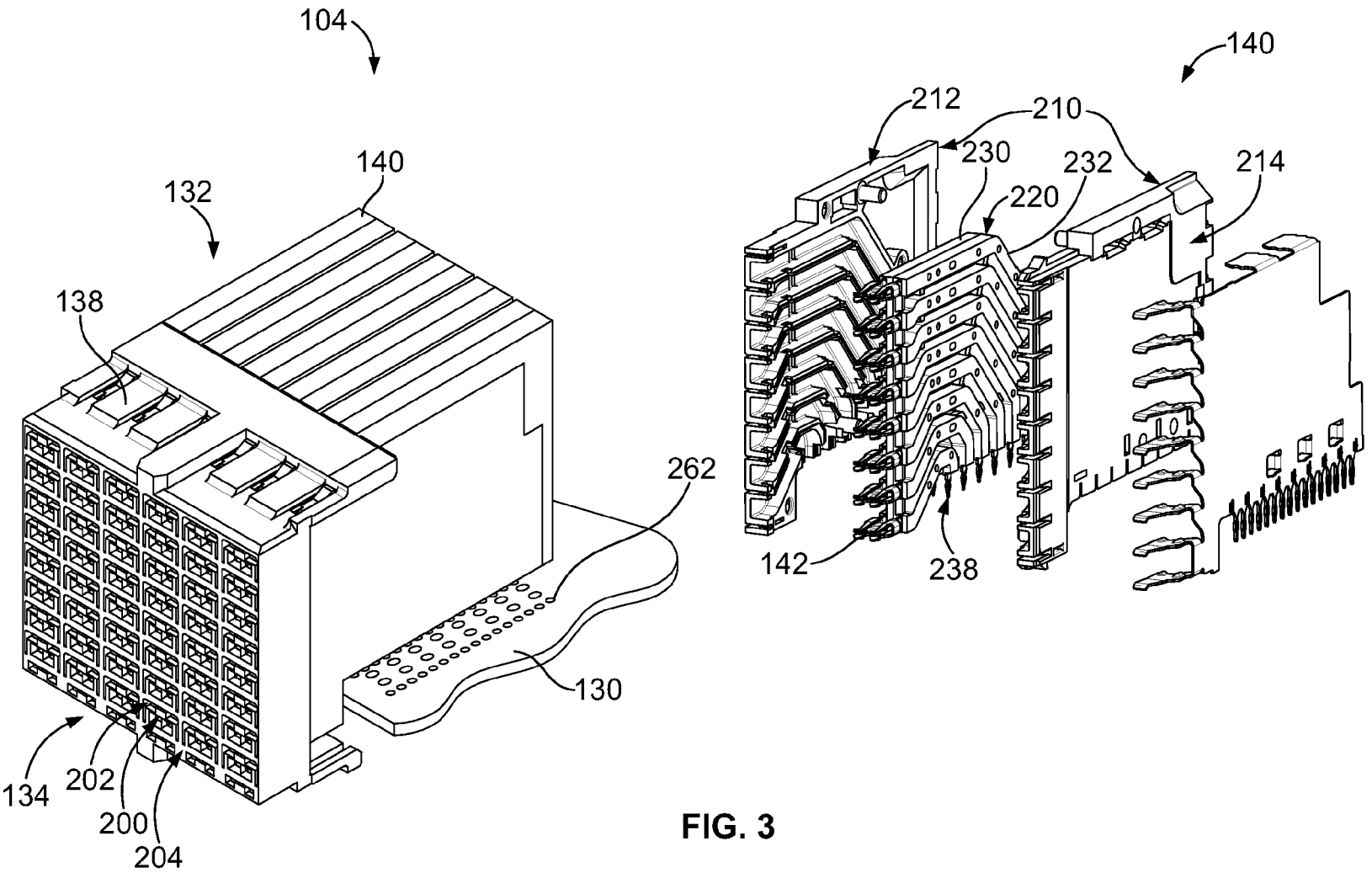
FIG. 3 is a perspective view of a receptacle connector that may be used with the communication system of FIG. 1.

Similar to the first receptacle connector 132, the second receptacle connector 152 includes a front housing 158 used to hold a plurality of contact modules 160. The contact modules 160 are held in a stacked configuration generally parallel to one another. The contact modules 160 hold a plurality of receptacle contacts (not shown) that are electrically connected to the second circuit board 150. The receptacle contacts are configured to be electrically connected to the header contacts 120 of the second header connector 118. The receptacle contacts of the contact modules 160 may be similar or identical to the receptacle contacts 142 (FIG. 3).

In the illustrated embodiment, the first circuit board 130 is oriented generally horizontally. The contact modules 140 of the first receptacle connector 132 are oriented generally vertically. The second circuit board 150 is oriented generally vertically. The contact modules 160 of the second receptacle connector 152 are oriented generally horizontally. As such, the first connector system 104 and the second connector system 106 may have an orthogonal orientation with respect to one another.

Although not shown, in some embodiments, the communication system 100 may include a loading mechanism. The loading mechanism may include, for example, latches or levers that fully mate the corresponding receptacle and header connectors. For instance, the loading mechanism may be operably coupled to the receptacle connector 132 and, when actuated, drive the receptacle connector 132 into the header connector 116 to assure that the receptacle and header connectors 132, 116 are fully mated.

Figure 2:
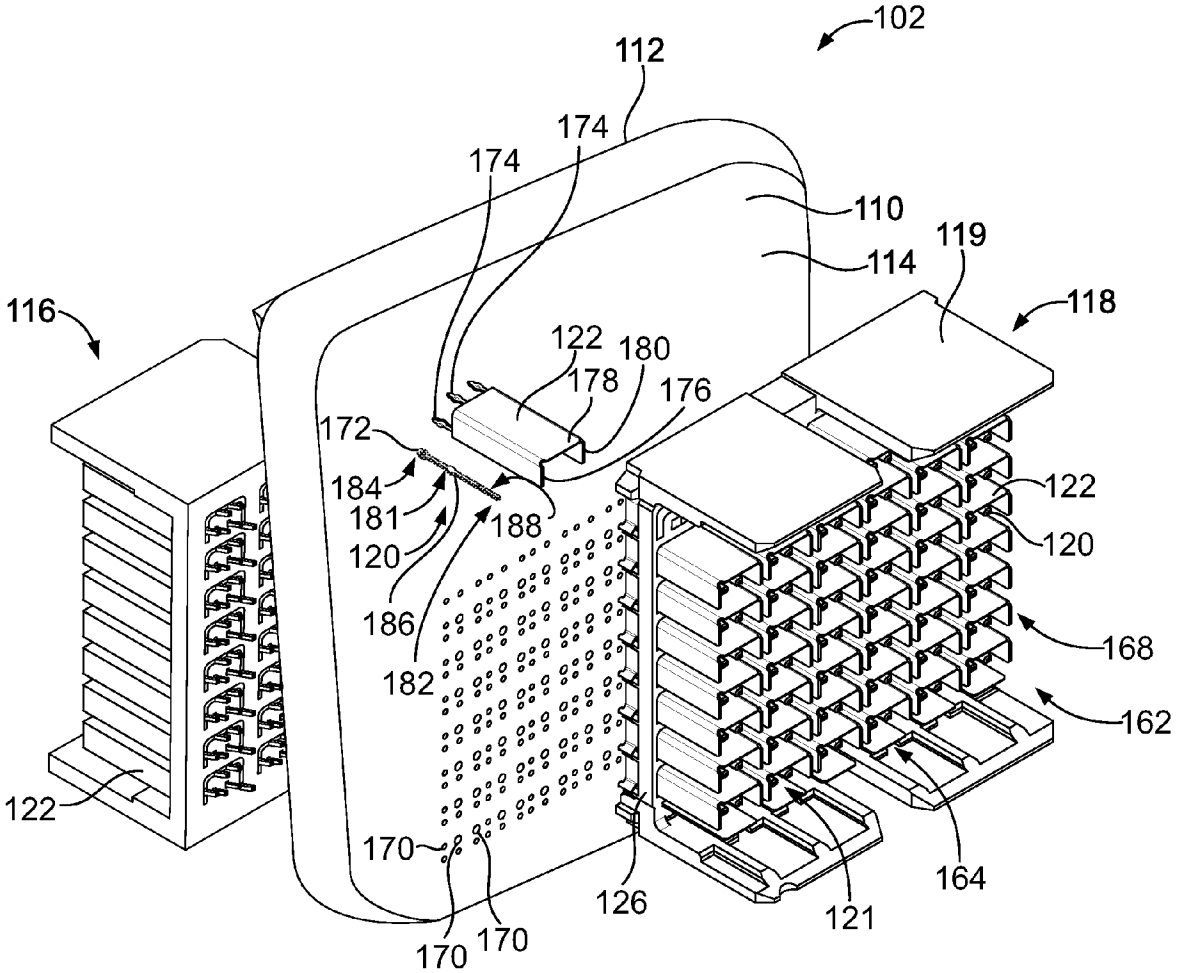
FIG. 2 is a perspective view of a circuit board assembly including a header connector that may be used with the communication system of FIG. 1.

FIG. 2 is a partially exploded view of the circuit board assembly 102 showing the first and second header connectors 116, 118 positioned for mounting to the circuit board 110. Although the following description is with respect to the second header connector 118, the description is also applicable to the first header connector 116. As shown, the connector housing 119 includes a contact end 162 that faces away from the second board side 114 of the circuit board 110. The connector housing 119 defines a housing cavity 164 that opens to the contact end 162 and is configured to receive the second receptacle connector 152 (FIG. 1) when the second receptacle connector 152 is advanced into the housing cavity 164. As shown, the second header connector 118 includes a contact array 168 that includes the header contacts 120 and the ground shields 122. The contact array 168 may include multiple signal pairs 121.

The conductive vias 170 extend into the circuit board 110. In an exemplary embodiment, the conductive vias 170 extend entirely through the circuit board 110 between the first and second board sides 112, 114. In other embodiments, the conductive vias 170 extend only partially through the circuit board 110. The conductive vias 170 are configured to receive the header contacts 120 of the first and second header connectors 116, 118. For example, the header contacts 120 include compliant pins 172 that are configured to be loaded into corresponding conductive vias 170. The compliant pins 172 mechanically engage and electrically couple to the conductive vias 170. Likewise, at least some of the conductive vias 170 are configured to receive compliant pins 174 of the ground shields 122. The compliant pins 174 mechanically engage and electrically couple to the conductive vias 170. The conductive vias 170 that receive the ground shields 122 may surround the pair of conductive vias 170 that receive the corresponding pair of header contacts 120.

The ground shields 122 are C-shaped and provide shielding on three sides of the signal pair 121. The ground shields 122 have a plurality of walls, specifically three planar walls 176, 178, 180. The planar walls 176, 178, 180 may be integrally formed or alternatively, may be separate pieces. The compliant pins 174 extend from each of the planar walls 176, 178, 180 to electrically connect the planar walls 176, 178, 180 to the circuit board 110. The planar wall 178 defines a center wall or top wall of the ground shield 122. The planar walls 176, 180 define side walls that extend from the planar wall 178. The planar walls 176, 180 may be generally perpendicular to the planar wall 178. In alternative embodiments, other configurations or shapes for the ground shields 122 are possible in alternative embodiments. For example, more or fewer walls may be provided in alternative embodiments. The walls may be bent or angled rather than being planar. In other embodiments, the ground shields 122 may provide shielding for individual header contacts 120 or sets of contacts having more than two header contacts 120.

The header contact 120 includes a contact end 182 and a back end 184. A conductive pathway exists between the contact and back ends 182, 184. The back end 184 is configured to engage the circuit board 110. The contact end 182 may represent the portion of the header contact 120 that is located furthest from the circuit board 110 or the mounting wall 126 and is the first to engage or interface with the second receptacle connector 152 (FIG. 1). As such, the contact end 182 may also be referred to as the leading end or the mating end.

The header contact 120 also includes a contact body 181. The header contact 120 (or the contact body 181) includes a plurality of segments that are shaped differently from one another and may have different functions. For example, the header contact 120 includes the compliant pin 172, a base segment 186, and a mating segment 188. The compliant pin 172 includes the back end 184, and the mating segment 188 includes the contact end 182. As described above, the compliant pin 172 mechanically engages and electrically couples to a corresponding conductive via 170 of the circuit board 110.

The base segment 186 is sized and shaped to directly engage the mounting wall 126 of the connector housing 119. For example, the base segment 186 may be inserted into a passage (not shown) of the mounting wall 126 and engage the mounting wall 126 to form an interference fit therewith.

The mating segment 188 may represent the portion of the header contact 120 that is exposed within the housing cavity 164. As described below, the mating segment 188 (or a portion thereof) is configured to slidably engage a corresponding receptacle contact 142 (FIG. 3) during the mating operation.

FIG. 3 is a partially exploded view of the first connector system 104 including the first receptacle connector 132. Although the following description is with respect to the first receptacle connector 132, the description is also applicable to the second receptacle connector 152 (FIG. 1). FIG. 3 illustrates one of the contact modules 140 in an exploded state. The front housing 138 includes a plurality of contact openings 200, 202 at a contact end 204 of the front housing 138. The contact end 204 defines the mating interface 134 of the first receptacle connector 132 that engages the first header connector 116 (FIG. 1).

The contact modules 140 are coupled to the front housing 138 such that the receptacle contacts 142 are received in corresponding contact openings 200. Optionally, a single receptacle contact 142 may be received in each contact opening 200. The contact openings 200 receive corresponding header contacts 120 (FIG. 1) therein when the receptacle and header connectors 132, 116 are mated. The contact openings 202 receive corresponding ground shields 122 (FIG. 1) therein when the receptacle and header connectors 132, 116 are mated.

The front housing 138 may be manufactured from a dielectric material, such as, but not limited to, a plastic material, and may provide isolation between the contact openings 200 and the contact openings 202. The front housing 138 may isolate the receptacle contacts 142 and the header contacts 120 from the ground shields 122. In some embodiments, the contact module 140 includes a conductive holder 210. The conductive holder 210 may include a first holder member 212 and a second holder member 214 that are coupled together. The holder members 212, 214 may be fabricated from a conductive material. As such, the holder members 212, 214 may provide electrical shielding for the first receptacle connector 132. When the holder members 212, 214 are coupled together, the holder members 212, 214 define at least a portion of a shielding structure.

The conductive holder 210 is configured to support a frame assembly 220 that includes a pair of dielectric frames 230, 232. The dielectric frames 230, 232 are configured to surround signal conductors (not shown) that are electrically coupled to or include the receptacle contacts 142. Each signal conductor may also be electrically coupled to or may include a mounting contact 238. The mounting contacts 238 are configured to mechanically engage and electrically couple to conductive vias 262 of the first circuit board 130. Each of the receptacle contacts 142 may be electrically coupled to a corresponding mounting contact 238 through a corresponding signal conductor (not shown).

Figure 4:
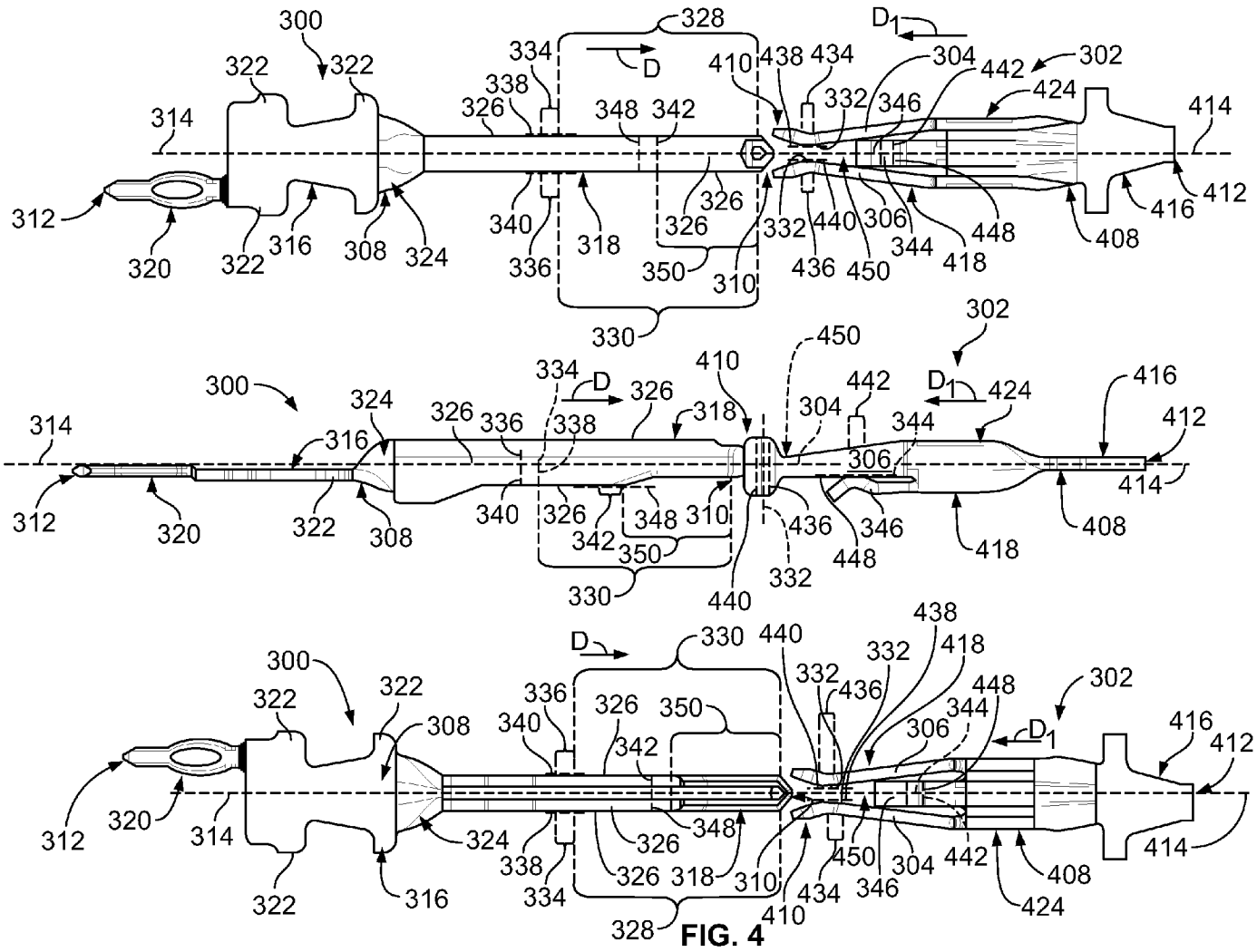
FIG. 4 is a top plan view, a bottom plan view, and a side elevational view of an electrical contact and another electrical contact aligned for mating with each other in accordance with an embodiment.

FIG. 4 illustrates an electrical contact 300 and another electrical contact 302 aligned for mating with each other in accordance with an embodiment. The contact 302 includes first and second contact fingers 304, 306. In some embodiments, the electrical contact 300 is a header contact and may be used as the header contact 120 (FIGS. 1 and 2) of the header connector 118 (FIGS. 1 and 2). The contact 302 may be a receptacle contact that engages the header contact, such as, but not limited to, the receptacle contact 142 (FIG. 3). In such embodiments, the electrical contacts 300, 302 are configured to communicate data signals therebetween. It should be understood, however, that the electrical contact 300 and the electrical contact 302 may have different configurations and/or be used in other applications. It should also be understood that the electrical contact 300 and the electrical contact 302 may be ground conductors in alternative embodiments. In such embodiments, the ground conductors may shield adjacent signal conductors (or signal pairs) from one another and/or provide a return path. Each of the contacts 300, 302 may be referred to herein as "another contact" and/or an "other contact".

The electrical contact 300 has a contact body 308 and may include features that are similar to the features of the header contact 120 (FIGS. 1 and 2). For example, the electrical contact 300 includes a contact end 310. The electrical contact 300 also includes a back or proximal end 312 that is similar to the back end 184 (FIG. 2). The back end 312 may be configured to engage a circuit board, such as, but not limited to, the circuit board 110 (FIGS. 1 and 2). In other embodiments, the electrical contact 300 may be a longer conductor, such as, but not limited to, conductors found in lead frames.

As shown, the electrical contact 300 is oriented with respect to a central longitudinal axis 314 that extends therethrough between the back end 312 and the contact end 310. The central longitudinal axis 314 extends through a geometric center of a cross-sectional profile of the contact body 308. In the illustrated embodiment, the central longitudinal axis 314 appears to be a straight line. In other embodiments, however, the central longitudinal axis 314 may bend as the shape of the contact body 308 changes along a length of the electrical contact 300.

The electrical contact 300 (or the contact body 308) includes a plurality of contact segments or portions that may be shaped differently from one another and/or may have different functions. For example, the electrical contact 300 includes a base segment 316 and a mating segment 318. The electrical contact 300 may also include a compliant pin 320. The compliant pin 320 may be similar or identical to the compliant pin 172 (FIG. 2) and include the back end 312 of the electrical contact 300. The mating segment 316 includes the contact end 310. The contact end 310 may represent the distal end of the electrical contact 300. In some embodiments, the contact end 310 may engage the electrical contact 302 before other portions of the electrical contact 300 engage the electrical contact 302.

The base segment 316 is sized and shaped to directly engage a connector housing (not shown), such as, but not limited to, the connector housing 119 (FIGS. 1 and 2). For example, the base segment 316 includes protrusions 322 that are configured to engage surfaces (not shown) of the connector housing. The protrusions 322 may form a frictional engagement between the electrical contact 300 and the connector housing. As shown, the base segment 316 has a planar shape, but other shapes may be used in other embodiments.

The mating segment 318 may represent the portion of the electrical contact 300 that is exposed for engaging (i.e., mating with) the electrical contact 302 during a mating operation. In the illustrated embodiment, the mating segment 318 is configured to slidably engage the electrical contact 302 during the mating operation in which the electrical contacts 300, 302 move toward each other. The electrical contact 300 may be stamped from a sheet of material and shaped to include the features described herein.

The mating segment 318 of the electrical contact 300 extends a length along the central longitudinal axis 314 from a base 324 of the mating segment 318 to the contact end 310. The mating segment has a contact surface 326 that defines an exterior surface of the mating segment 318 or the contact body 308. Portions of the contact surface 326 are configured to engage the electrical contact 302 or, more specifically, the contact fingers 304, 306. In the illustrated embodiment, the contact surface 326 includes a first wipe runway 328 and a second wipe runway 330 that are configured to engage engagement surfaces 332 of the contact fingers 304, 306, respectively. The first and second runways 328, 330 are separate and extend parallel to each other. In the illustrated embodiment, the first and second runways 328, 330 face in opposite directions and extend parallel to the central longitudinal axis 314. The first and second runways 328, 330 represent paths along the contact surface 326 that the engagement surfaces 332 of the respective contact fingers 304, 306 directly engage and slide (or wipe) along during the mating operation.

In the illustrated embodiment, the first and second runways 328, 330 extend from the contact end 310 to respective mating zones 334, 336. The mating zones 334, 336 are localized areas of the contact surface 326 where the engagement surfaces 332 of the contact fingers 304, 306, respectively, intimately engage the mating segment 318 during operation. In other words, the mating zones 334, 336 are areas where an electrical connection is formed between the electrical contacts 300, 302. The mating zones 334, 336 are the final resting locations of the engagement surfaces 332 of the contact fingers 304, 306. As shown in FIG. 4, the mating zones 334, 336 are configured to intimately engage the engagement surfaces 332 of the electrical contact 302 in respective planes 338, 340. Each of the mating zones 334, 336 may be referred to herein as a "first" and/or a "third" mating zone. Each of the planes 338, 340 may be referred to herein as a "first" and/or a "third" plane.

The contact surface 326 of the mating segment 318 also includes a mating zone 342 that is a localized area of the contact surface 326 where an engagement surface 344 of a contact tab 346 of the electrical contact 302 intimately engages the mating segment 318 during operation. In other words, the mating zone 342 is an area where an electrical connection is formed between the electrical contacts 300, 302. The mating zone 342 is the final resting location of the engagement surface 344 of the contact tab 346. The mating zone 342 is configured to intimately engage the engagement surface 344 of the electrical contact 302 in a plane 348. The mating zone 342 may be referred to herein as a "second" mating zone. The plane 348 may be referred to herein as a "second" plane.

As should be apparent from FIG. 4, the mating zone 342 is offset from each of the mating zones 334, 336 along the length of the mating segment 318 (i.e., along the central longitudinal axis 314) in a direction D toward the contact end 310. Moreover, as also shown in FIG. 4, the plane 348 of the mating zone 342 is oriented approximately perpendicular to each of the planes 338, 340 of the respective mating zones 334, 336. The mating zone 342 may be referred to herein as a "second" mating zone. The plane 348 may be referred to herein as a "second" plane.

In the illustrated embodiment, the contact surface 326 includes a third wipe runway 350 that is configured to engage the engagement surface 344 of the contact tab 346. The third runway 350 extends parallel to the first and second runways 328, 330 and parallel to the central longitudinal axis 314. The third runway 350 represents a path along the contact surface 326 that the engagement surface 344 of the contact tab 346 directly engages and slides (or wipes) along during the mating operation. In the illustrated embodiment, the third runway 350 extends from the contact end 310 to the mating zone 342.

In the illustrated embodiment, the mating segment 318 of the electrical contact 300 has a folded pin structure, but the mating segment 318 may have any other structure, shape, geometry, and/or the like. For example, the mating segment 318 may have, but is not limited to, other elongate linear structures, such as, but not limited to, a post structure, a different pin structure (e.g., a solid pin, a hollow pin, and/or the like), a peg structure, a blade structure, and/or the like. Although shown as being used in operation as a plug in the illustrated embodiment, alternatively the mating segment 318 is not used as a plug.

The electrical contact 302 has a contact body 408 and may include features that are similar to the features of the receptacle contact 142 (FIG. 3). The electrical contact 302 includes a contact end 410. The electrical contact 302 also includes a back or proximal end 412. The back end 412 may be configured to terminate a longer conductor, such as, but not limited to, conductors found in lead frames (e.g., the signal conductors of the contact modules 140 shown in FIG. 3). In other embodiments, the electrical contact 302 may be a conductor that is configured to engage a circuit board.

As shown, the electrical contact 302 is oriented with respect to a central longitudinal axis 414 that extends therethrough between the back end 412 and the contact end 410. The central longitudinal axis 414 extends through a geometric center of a cross-sectional profile of the contact body 408. In the illustrated embodiment, the central longitudinal axis 414 appears to be a straight line. In other embodiments, however, the central longitudinal axis 414 may bend as the shape of the contact body 408 changes along a length of the electrical contact 302.

The electrical contact 302 (or the contact body 408) includes a plurality of contact segments or portions that may be shaped differently from one another and/or may have different functions. For example, the electrical contact 302 includes a base segment 416 and a mating segment 418. The base segment 416 includes the back end 412 of the electrical contact 302. The mating segment 418 includes the contact end 410. The contact end 410 may represent the distal end of the electrical contact 302. In some embodiments, the contact end 410 may engage the electrical contact 300 before other portions of the electrical contact 302 engage the electrical contact 300.

The base segment 416 is sized and shaped to be held by the dielectric frames (not shown) of a contact module (not shown), such as, but not limited to the dielectric frames 230, 232 (FIG. 3) of the contact module 140. As shown, the base segment 416 has a planar shape, but other shapes may be used in other embodiments.

The mating segment 418 may represent the portion of the electrical contact 302 that is exposed for engaging (i.e., mating with) the electrical contact 300 during a mating operation. In the illustrated embodiment, the mating segment 418 is configured to slidably engage the electrical contact 300 during the mating operation in which the electrical contacts 300, 302 move toward each other. The electrical contact 302 may be stamped from a sheet of material and shaped to include the features described herein.

The mating segment 418 of the electrical contact 302 extends a length along the central longitudinal axis 414 from a base 424 of the mating segment 418 to the contact end 410. Specifically, the mating segment 418 includes the contact fingers 304, 306, which extend outward from the base 424 along the central longitudinal axis 414 and each define (i.e., include) a portion of the contact end 410. In the illustrated embodiment, each of the contact fingers 304, 306 is a spring that is configured to be resiliently deflected when engaged with the electrical contact 300.

Each contact finger 304, 306 includes the engagement surface 332 described above, which is configured to intimately engage the contact surface 326 of the electrical contact 300. Specifically, the engagement surfaces 332 of the contact fingers 304, 306 directly engage and slide (or wipe) along the first and second runways 328, 330, respectively, of the contact surface 326 of the electrical contact 300 as the electrical contacts 300, 302 are mated together. The engagement surfaces 332 of the contact fingers 304, 306 define mating zones 434, 436 of the electrical contact 302. The mating zones 434, 436 are localized areas of the mating segment 418 where the engagement surfaces 332 of the contact fingers 304, 306, respectively, intimately engage the contact surface 326 at the mating zones 334, 336, respectively, of the electrical contact 300 to form an electrical connection between the electrical contacts 300, 302. As shown in FIG. 4, the mating zones 434, 436 are configured to intimately engage the contact surface 326 of the electrical contact 300 in respective planes 438, 440. Each of the mating zones 434, 436 may be referred to herein as a "second" and/or a "third" mating zone. Each of the planes 438, 440 may be referred to herein as a "second" and/or a "third" plane.

The mating segment 418 of the electrical contact 302 includes the contact tab 346, which extends outward from the base 424 along the central longitudinal axis 414. In the illustrated embodiment, the contact tab 346 is a spring that is configured to be resiliently deflected when engaged with the electrical contact 300.

The contact tab 346 includes the engagement surface 344 described above, which is configured to intimately engage the contact surface 326 of the electrical contact 300. Specifically, the engagement surface 344 of the contact tab 346 directly engages and slides (or wipes) along the third runway 350 of the contact surface 326 of the electrical contact 300 as the electrical contacts 300, 302 are mated together. Moreover, the engagement surface 344 of the contact tab 346 defines a mating zone 442 of the electrical contact 302. The mating zone 442 is a localized area of the mating segment 418 where the engagement surface 344 of the contact tab 346 intimately engages the contact surface 326 at the mating zone 342 of the electrical contact 300 to form an electrical connection between the electrical contacts 300, 302. As shown in FIG. 4, the mating zone 442 is configured to intimately engage the contact surface 326 of the electrical contact 300 in a plane 448.

Each of the mating zones 434, 436 is offset from the mating zone 442 along the length of the mating segment 418 (i.e., along the central longitudinal axis 414) in a direction $D_1$ toward the contact end 410, as is illustrated in FIG. 4. As should also be apparent from FIG. 4, the plane 448 of the mating zone 442 is oriented approximately perpendicular to each of the planes 438, 440 of the respective mating zones 434, 436. The mating zone 442 may be referred to herein as a "first" mating zone. The plane 448 may be referred to herein as a "first" plane.

In the illustrated embodiment, the contact fingers 304, 306 of the mating segment 418 of the electrical contact 302 are springs, but the contact fingers 304, 306 may have any other structure, shape, geometry, and/or the like in other embodiments. Although the contact tab 346 of the mating segment 418 of the electrical contact 302 is a spring in the illustrated embodiment, the contact tab 346 may have any other structure, shape, geometry, and/or the like in other embodiments. Moreover, the mating segment 418 of the electrical contact 302 may include any other structure, shape, geometry, and/or the like in addition or alternatively to the contact fingers 304, 306 and/or the contact tab 346 in other embodiments. Although two are shown, the mating segment 418 of the electrical contact 302 may include any number of contact fingers 304, 306. For example, in some other embodiments, the mating segment 418 of the electrical contact 302 includes only a single contact finger 304 or 306. Moreover, the mating segment 418 of the electrical contact 302 may include any number of the contact tabs 346. Each of the contact fingers 304, 306 may be referred to herein as a "spring finger".

As shown, the engagement surfaces 332 of the contact fingers 304, 306 face each other with a receptacle 450 therebetween, such that the mating segment 418 of the electrical contact 302 is used in operation as a receptacle that receives the plug of the mating segment 318 of the electrical contact 300 therein. But, in other embodiments the mating segment 418 of the electrical contact 302 does not define a receptacle that receives a plug therein. Moreover, although shown as being aligned and facing (i.e., shown as opposing) each other such that the engagement surfaces 332 engage opposite sides of the mating segment 318 at approximately the same location along the corresponding sides (i.e., along the central longitudinal axis 314), other relative orientations may be provided in other embodiments (e.g., the engagement surfaces 332 may not face each other, the engagement surfaces 332 of the contact fingers 304, 306 may be located at different locations along the central longitudinal axis 314, and/or the like).

Figure 5:
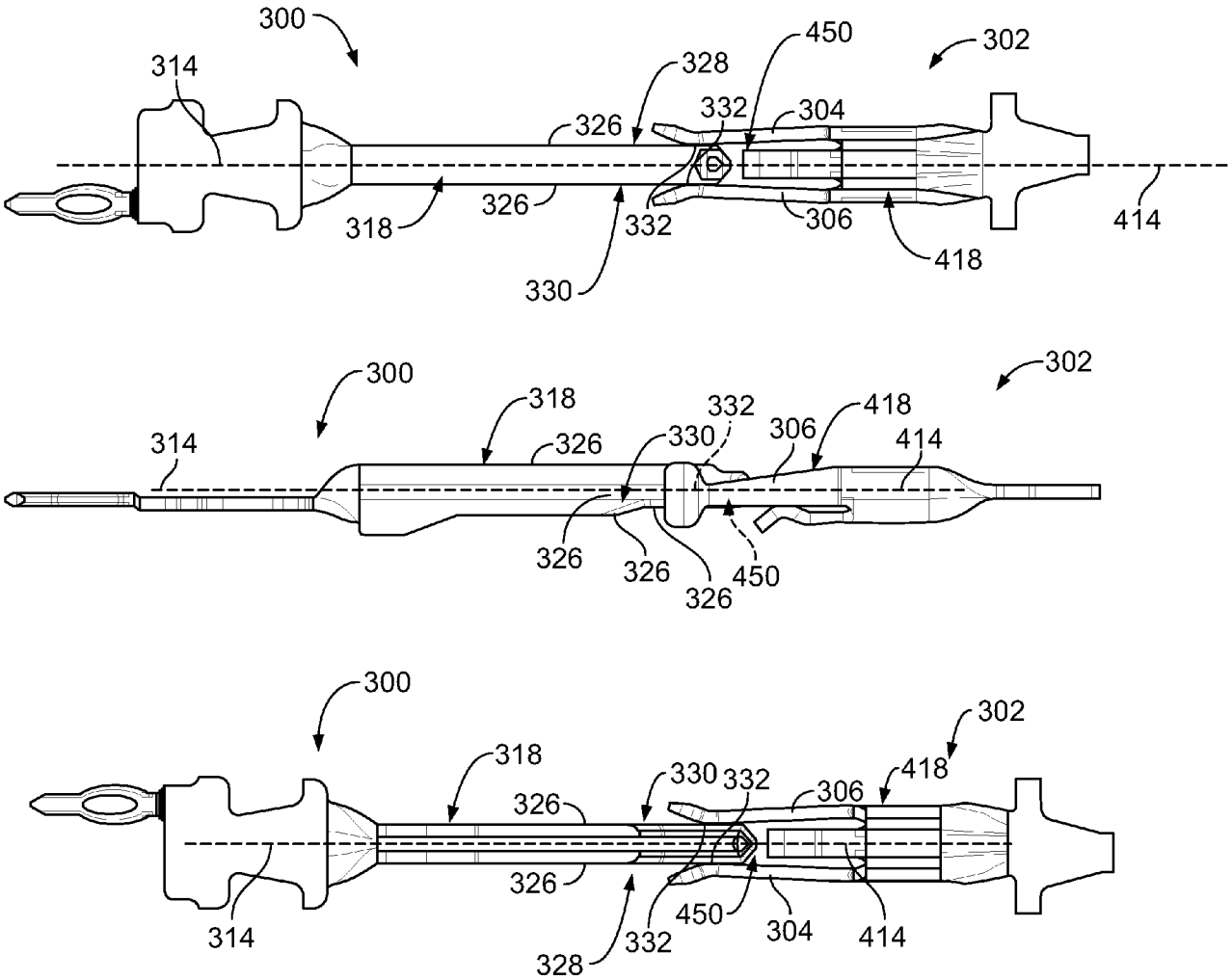
FIG. 5 is another top plan view, bottom plan view, and side elevational view of the electrical contacts shown in FIG. 4 illustrating the electrical contacts being mated with each other.

The electrical contacts 300, 302 are mated together (sometimes referred to herein as a "mating operation") by aligning the central longitudinal axes 314, 414 and moving the mating segments 318, 418 relatively toward each other along the aligned axes 314, 414, as illustrated FIG. 5. During the mating operation, the engagement surfaces 332 of contact fingers 304, 306 directly engage the contact surface 326 of the mating segment 318 at the first and second runways 328, 330, respectively, of the electrical contact 300, as shown in FIG. 5. In the illustrated embodiment, the contact surface 326 of the electrical contact 300 deflects the contact fingers 304, 306 radially outward relative to the central longitudinal axes 314, 414 as the contact fingers 304, 306 engage the contact surface 326, as can be seen from a comparison of FIGS. 4 and 5.

Figure 6:
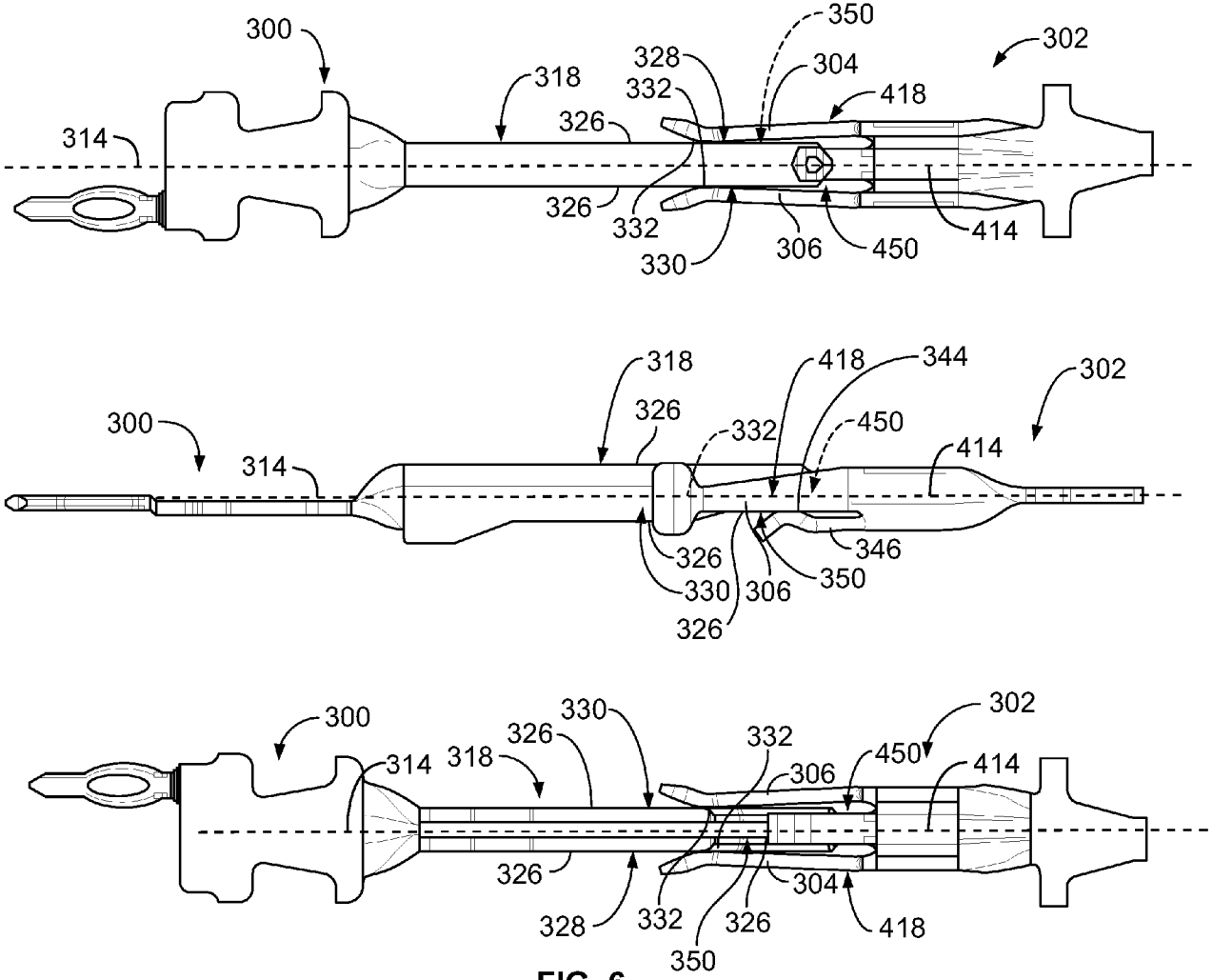
FIG. 6 is another top plan view, bottom plan view, and side elevational view illustrating the electrical contacts shown in FIGS. 4 and 5 being mated with each other.
Figure 7:
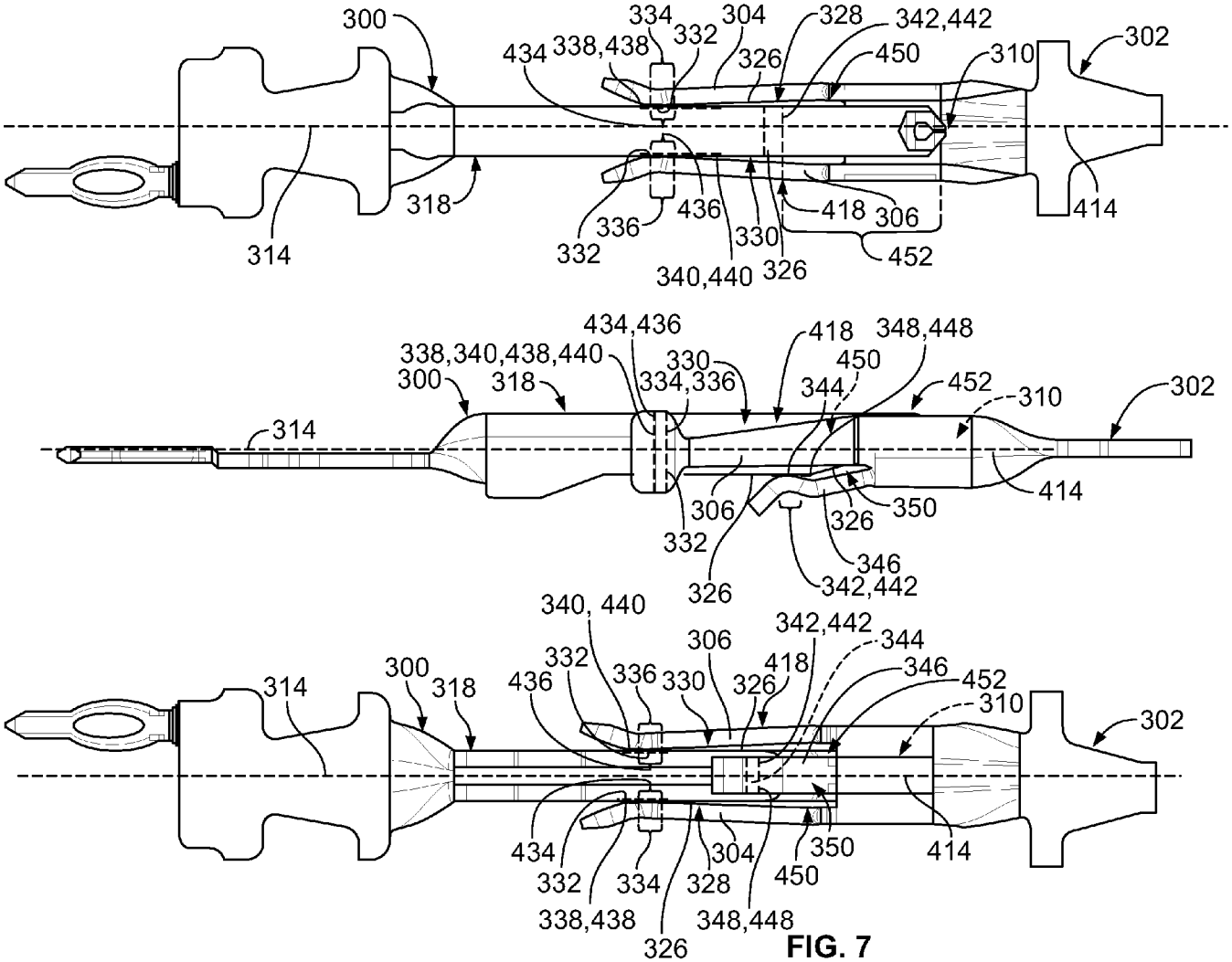
FIG. 7 is another top plan view, bottom plan view, and side elevational view illustrating the electrical contacts shown in FIGS. 4-6 as fully mated together.

As shown in FIG. 5-7, the mating segment 318 of the electrical contact 300 is used as a plug that is received within the receptacle 450 of the mating segment 418 of the electrical contact 302 during the mating operation. As described above, other arrangements are possible in other embodiments (e.g., embodiments wherein the mating segment 418 of the electrical contact 302 includes only a single contact finger 304 or 306).

A comparison of FIGS. 5 and 6 illustrates that the engagement surfaces 332 of the contact fingers 304, 306 slide (or wipe) along the first and second runways 328, 330, respectively, as the mating segments 318, 418 are moved further together along the aligned central longitudinal axes 314, 414 (i.e., as the mating segment 318 is received further into the receptacle 450 in the illustrated embodiment) during the mating operation. At the position of the mating operation illustrated in FIG. 6, the engagement surface 344 of the contact tab 346 of the mating segment 418 has directly engaged the contact surface 326 of the mating segment 318 at the third runway 350 of the electrical contact 300. Moreover, the mating segment 318 of the electrical contact 300 has been received further into the receptacle 450 of the mating segment 418 of the electrical contact 302 at the position of the mating operation illustrated in FIG. 6. In the illustrated embodiment, the contact surface 326 of the electrical contact 300 deflects the contact tab 346 radially outward relative to the central longitudinal axes 314, 414 as the contact tab 346 engages the contact surface 326, as can be seen from a comparison of FIGS. 5 and 6.

FIG. 7 illustrates the electrical contacts 300, 302 as fully mated together. In the fully mated position, the mating segment 318 of the electrical contact 300 has been fully received into the receptacle 450 of the mating segment 418 of the electrical contact 302. The engagement surfaces 332 of the contact fingers 304, 306 have slid (or wiped) further along the first and second runways 328, 330, respectively, of the contact surface 326 into the mating zones 334, 336, respectively, of the mating segment 318. The engagement surface 332 of the contact finger 304 is intimately engaged with the contact surface 326 of the electrical contact 300 at the mating zones 334, 434. As can be seen in FIG. 7, the mating zones 334, 434 are aligned with each other when the electrical contacts 300, 302 are fully mated. Accordingly, the planes 338, 438 of the respective mating zones 334, 434 are aligned with each other when the electrical contacts 300, 302 are fully mated, as is shown in FIG. 7. Similarly, the engagement surface 332 of the contact finger 306 is intimately engaged with the contact surface 326 of the electrical contact 300 at the mating zones 336, 436. The mating zones 336, 436 are aligned with each other when the electrical contacts 300, 302 are fully mated, as is shown in FIG. 7. The planes 340, 440 of the respective mating zones 336, 436 thus are aligned with each other when the electrical contacts 300, 302 are fully mated.

As illustrated in FIG. 7, the aligned mating zones 334, 434 of the contact finger 304 extend at approximately the same location along the length of the central longitudinal axes 314, 414 as the aligned mating zones 336, 436 of the contact finger 306 when the electrical contacts 300, 302 are fully mated. Moreover, the aligned planes 338, 438 of the contact finger 304 extend approximately parallel to the aligned planes 340, 440 of the contact finger 306 when the electrical contacts 300, 302 are fully. In some alternative embodiments, the aligned mating zones 334, 434 of the contact finger 304 extend at a different location along the length of the central longitudinal axes 314, 414 than the aligned mating zones 336, 436 of the contact finger 306 when the electrical contacts 300, 302 are fully mated.

The engagement surface 344 of the contact tab 346 has slid (or wiped) along the third runway 350 of the contact surface 326 into the mating zone 342 of the mating segment 318. The engagement surface 344 of the contact tab 346 is intimately engaged with the contact surface 326 of the electrical contact 300 at the mating zones 342, 442. As can be seen in FIG. 7, the mating zones 342, 442 are aligned with each other when the electrical contacts 300, 302 are fully mated. Accordingly, and as illustrated in FIG. 7, the planes 348, 448 of the respective mating zones 342, 442 are aligned with each other when the electrical contacts 300, 302 are fully mated.

FIG. 7 illustrates that the aligned mating zones 342, 442 of the contact tab 346 are offset from the aligned mating zones 334, 434 of the contact finger 304 along the length of the central longitudinal axes 314, 414. As is also shown in FIG. 7, the aligned mating zones 342, 442 of the contact tab 346 are offset from the aligned mating zones 336, 436 of the contact finger 306 along the length of the central longitudinal axes 314, 414. FIG. 7 also illustrates that the aligned planes 348, 448 of the contact tab 346 extend approximately perpendicular to the aligned planes 338, 438 of the contact finger 304; and that the aligned planes 348, 448 of the contact tab 346 extend approximately perpendicular to the aligned planes 340, 440 of the contact finger 306. Accordingly, the electrical contacts 300, 302 mate together at at least two points of engagement (i.e., contact) that are offset from each other along the length of the mated electrical contacts 300, 302 and that extend in approximately perpendicular planes.

When the contact fingers 304, 306 are in deflected conditions as shown in FIG. 7, each of the contact fingers 304, 306 may generate a normal force that presses the corresponding engagement surface 332 against the contact surface 326 of the mating segment 318 such that a sufficient electrical connection is made between the contact finger 304, 306 and the mating segment 318. Similarly, the contact tab 346 may generate a normal force that presses the engagement surface 344 against the contact surface 326 of the mating segment 318 such that a sufficient electrical connection is made between the contact tab 346 and the mating segment 318 when the contact tab 346 is in deflected condition as shown in FIG. 7. Each of the contact fingers 304, 306 and the contact tab 346 may be configured (e.g., sized, shaped, and/or the like) to generate a normal force of a designated value when in the deflected condition.

In the illustrated embodiment of the electrical contacts 300, 302, a stub portion 452 of the mating segment 318 of the electrical contact 300 is formed when the electrical contacts 300, 302 are mated together. Specifically, the stub portion 452 extends between the contact end 310 and the mating zone 342 of the mating segment 318. During operation, electrical energy may be reflected between the contact end 310 and the mating zone 342 and resonate therebetween.

The electrical contacts 300, 302 may reduce unwanted effects of reflected energy along the stub portion 452 by reducing the length of the stub portion 452. For example, the stub portion 452 is shorter in length as compared to an electrical contact that does not include the contact tab 346. Specifically, if the contact tab 346 was not included the stub portion 452 would extend from the contact end 310 to the mating zones 334, 434, 336, 436, which as shown in FIG. 7 is a greater distance than the length of the stub portion 452 (i.e., the distance from the contact end 310 to the mating zones 342, 442). By reducing the length of the stub portion 452, the electrical contacts 300, 302 may reduce the amount of energy that is resonated from the stub portion 452 such that less electromagnetic radiation permeates the interface between the mated electrical contacts 300, 302, which may, for example, reduce electromagnetic interference (EMI) such as, but not limited to, crosstalk and/or the like. In some embodiments, the length of the stub portion 452 is reduced by an amount that prevents the stub portion 452 from acting as an antenna.

By reducing the amount of electromagnetic radiation that permeates the interface between the mated electrical contacts 300, 302, the electrical contacts 300, 302 may require less electromagnetic shielding, which may reduce the cost of manufacturing an electrical connector system (e.g., the system 100 shown in FIG. 1) that includes the electrical contacts 300, 302.

Figure 8:
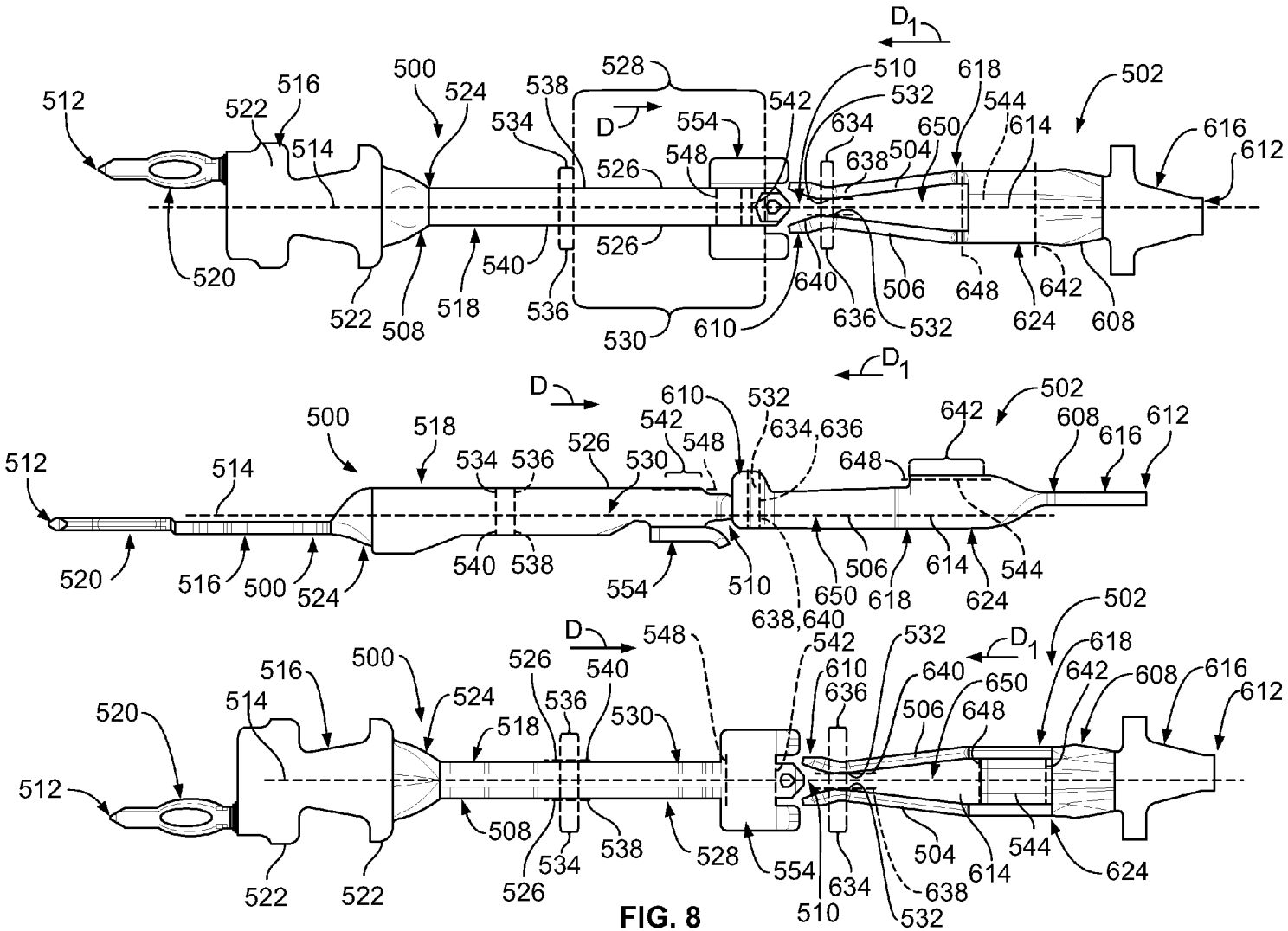
FIG. 8 is a top plan view, a bottom plan view, and a side elevational view of an electrical contact and another electrical contact aligned for mating with each other in accordance with another embodiment.

FIG. 8 illustrates an electrical contact 500 and another electrical contact 502 aligned for mating with each other in accordance with an embodiment. The contact 502 includes first and second contact fingers 504, 506. In some embodiments, the electrical contact 500 is a header contact and may be used as the header contact 120 (FIGS. 1 and 2) of the header connector 118 (FIGS. 1 and 2). The contact 502 may be a receptacle contact that engages the header contact, such as, but not limited to, the receptacle contact 142 (FIG. 3). In such embodiments, the electrical contacts 500, 502 are configured to communicate data signals therebetween. It should be understood, however, that the electrical contact 500 and the electrical contact 502 may have different configurations and/or be used in other applications. It should also be understood that the electrical contact 500 and the electrical contact 502 may be ground conductors in alternative embodiments. In such embodiments, the ground conductors may shield adjacent signal conductors (or signal pairs) from one another and/or provide a return path. Each of the contacts 500, 502 may be referred to herein as "another contact" and/or an "other contact".

The electrical contact 500 has a contact body 508 and may include features that are similar to the features of the header contact 120 (FIGS. 1 and 2). For example, the electrical contact 500 includes a contact end 510. The electrical contact 500 also includes a back or proximal end 512 that is similar to the back end 184 (FIG. 2). The back end 512 may be configured to engage a circuit board, such as, but not limited to, the circuit board 110 (FIGS. 1 and 2). In other embodiments, the electrical contact 500 may be a longer conductor, such as, but not limited to, conductors found in lead frames.

As shown, the electrical contact 500 is oriented with respect to a central longitudinal axis 514 that extends therethrough between the back end 512 and the contact end 510. The central longitudinal axis 514 extends through a geometric center of a cross-sectional profile of the contact body 508. In the illustrated embodiment, the central longitudinal axis 514 appears to be a straight line. In other embodiments, however, the central longitudinal axis 514 may bend as the shape of the contact body 508 changes along a length of the electrical contact 500.

The electrical contact 500 (or the contact body 508) includes a plurality of contact segments or portions that may be shaped differently from one another and/or may have different functions. For example, the electrical contact 500 includes a base segment 516 and a mating segment 518. The electrical contact 500 may also include a compliant pin 520. The compliant pin 520 may be similar or identical to the compliant pin 172 (FIG. 2) and include the back end 512 of the electrical contact 500. The mating segment 516 includes the contact end 510. The contact end 510 may represent the distal end of the electrical contact 500. In some embodiments, the contact end 510 may engage the electrical contact 502 before other portions of the electrical contact 500 engage the electrical contact 502.

The base segment 516 is sized and shaped to directly engage a connector housing (not shown), such as, but not limited to, the connector housing 119 (FIGS. 1 and 2). For example, the base segment 516 includes protrusions 522 that are configured to engage surfaces (not shown) of the connector housing. The protrusions 522 may form a frictional engagement between the electrical contact 500 and the connector housing. As shown, the base segment 516 has a planar shape, but other shapes may be used in other embodiments.

The mating segment 518 may represent the portion of the electrical contact 500 that is exposed for engaging (i.e., mating with) the electrical contact 502 during a mating operation. In the illustrated embodiment, the mating segment 518 is configured to slidably engage the electrical contact 502 during the mating operation in which the electrical contacts 500, 502 move relatively together. The electrical contact 500 may be stamped from a sheet of material and shaped to include the features described herein.

The mating segment 518 of the electrical contact 500 extends a length along the central longitudinal axis 514 from a base 524 of the mating segment 518 to the contact end 510. The mating segment has a contact surface 526 that defines an exterior surface of the mating segment 518 or the contact body 508. Portions of the contact surface 526 are configured to engage the electrical contact 502 or, more specifically, the contact fingers 504, 506. In the illustrated embodiment, the contact surface 526 includes a first wipe runway 528 and a second wipe runway 530 that are configured to engage engagement surfaces 532 of the contact fingers 504, 506, respectively. The first and second runways 528, 530 are separate and extend parallel to each other. In the illustrated embodiment, the first and second runways 528, 530 face in opposite directions and extend parallel to the central longitudinal axis 514. The first and second runways 528, 330 represent paths along the contact surface 526 that the engagement surfaces 532 of the respective contact fingers 504, 506 directly engage and slide (or wipe) along during the mating operation.

In the illustrated embodiment, the first and second runways 528, 530 extend from the contact end 510 to respective mating zones 534, 536. The mating zones 534, 536 are localized areas of the contact surface 526 where the engagement surfaces 532 of the contact fingers 504, 506, respectively, intimately engage the mating segment 518 during operation. In other words, the mating zones 534, 536 are areas where an electrical connection is formed between the electrical contacts 500, 502. The mating zones 534, 536 are the final resting locations of the engagement surfaces 532 of the contact fingers 504, 506. As shown in FIG. 8, the mating zones 534, 536 are configured to intimately engage the engagement surfaces 532 of the electrical contact 502 in respective planes 538, 540. Each of the mating zones 534, 536 may be referred to herein as a "first" and/or a "third" mating zone. Each of the planes 538, 540 may be referred to herein as a "first" and/or a "third" plane.

The contact surface 526 of the mating segment 518 also includes a mating zone 542 that is a localized area of the contact surface 526 where an engagement surface 544 of a base 624 of a mating segment 618 of the electrical contact 502 intimately engages the mating segment 518 during operation. In other words, the mating zone 542 is an area where an electrical connection is formed between the electrical contacts 500, 502. The mating zone 542 is the final resting location of the engagement surface 544 of the mating segment 618 of the electrical contact 502. The mating zone 542 is configured to intimately engage the engagement surface 544 of the electrical contact 502 in a plane 548. The mating zone 542 may be referred to herein as a "second" mating zone. The plane 548 may be referred to herein as a "second" plane.

As should be apparent from FIG. 8, the mating zone 542 is offset from each of the mating zones 534, 536 along the length of the mating segment 518 (i.e., along the central longitudinal axis 514) in a direction D toward the contact end 510. Moreover, as also shown in FIG. 8, the plane 548 of the mating zone 542 is oriented approximately perpendicular to each of the planes 538, 540 of the respective mating zones 534, 536.

The mating segment 518 of the electrical contact 500 includes a guide 554 that is configured to guide the contact fingers 504, 506 of the electrical contact 502 during a mating operation. In the illustrated embodiment, the guide 554 is located at the contact end 510, but the guide 554 may have other locations along the length of the mating segment 518 in other embodiments.

In the illustrated embodiment, the mating segment 518 of the electrical contact 500 has a folded pin structure, but the mating segment 518 may have any other structure, shape, geometry, and/or the like. For example, the mating segment 518 may have, but is not limited to, other elongate linear structures, such as, but not limited to, a post structure, a different pin structure (e.g., a solid pin, a hollow pin, and/or the like), a peg structure, a blade structure, and/or the like. Although shown as being used in operation as a plug in the illustrated embodiment, alternatively the mating segment 518 is not used as a plug.

The electrical contact 502 has a contact body 608 and may include features that are similar to the features of the receptacle contact 142 (FIG. 3). The electrical contact 502 includes a contact end 610. The electrical contact 502 also includes a back or proximal end 612. The back end 612 may be configured to terminate a longer conductor, such as, but not limited to, conductors found in lead frames (e.g., the signal conductors of the contact modules 140 shown in FIG. 3). In other embodiments, the electrical contact 502 may be a conductor that is configured to engage a circuit board.

As shown, the electrical contact 502 is oriented with respect to a central longitudinal axis 614 that extends therethrough between the back end 612 and the contact end 610. The central longitudinal axis 614 extends through a geometric center of a cross-sectional profile of the contact body 608. In the illustrated embodiment, the central longitudinal axis 614 appears to be a straight line. In other embodiments, however, the central longitudinal axis 614 may bend as the shape of the contact body 608 changes along a length of the electrical contact 502.

The electrical contact 502 (or the contact body 608) includes a plurality of contact segments or portions that may be shaped differently from one another and/or may have different functions. For example, the electrical contact 502 includes a base segment 616 and the mating segment 618. The base segment 616 includes the back end 612 of the electrical contact 502. The mating segment 618 includes the contact end 610. The contact end 610 may represent the distal end of the electrical contact 502. In some embodiments, the contact end 610 may engage the electrical contact 500 before other portions of the electrical contact 502 engage the electrical contact 500.

The base segment 616 is sized and shaped to be held by the dielectric frames (not shown) of a contact module (not shown), such as, but not limited to the dielectric frames 230, 232 (FIG. 3) of the contact module 140. As shown, the base segment 616 has a planar shape, but other shapes may be used in other embodiments.

The mating segment 618 may represent the portion of the electrical contact 502 that is exposed for engaging (i.e., mating with) the electrical contact 500 during a mating operation. In the illustrated embodiment, the mating segment 618 is configured to slidably engage the electrical contact 500 during the mating operation in which the electrical contacts 500, 502 move relatively together. The electrical contact 602 may be stamped from a sheet of material and shaped to include the features described herein.

The mating segment 618 of the electrical contact 502 extends a length along the central longitudinal axis 614 from the base 624 of the mating segment 618 to the contact end 610. Specifically, the mating segment 618 includes the contact fingers 504, 506, which extend outward from the base 624 along the central longitudinal axis 614 and each define (i.e., include) a portion of the contact end 610. In the illustrated embodiment, each of the contact fingers 504, 506 is a spring that is configured to be resiliently deflected when engaged with the electrical contact 500.

Each contact finger 504, 506 includes the engagement surface 532 described above, which is configured to intimately engage the contact surface 526 of the electrical contact 500. Specifically, the engagement surfaces 532 of contact fingers 504, 506 directly engage and slide (or wipe) along the first and second runways 528, 530, respectively, of the contact surface 526 of the electrical contact 500 as the electrical contacts 500, 502 are mated together. The engagement surfaces 532 of the contact fingers 504, 506 define mating zones 634, 636 of the electrical contact 502. The mating zones 634, 636 are localized areas of the mating segment 618 where the engagement surfaces 532 of the contact fingers 504, 506, respectively, intimately engage the contact surface 526 at the mating zones 534, 536, respectively, of the electrical contact 500 to form an electrical connection between the electrical contacts 500, 502. As shown in FIG. 8, the mating zones 634, 636 are configured to intimately engage the contact surface 526 of the electrical contact 500 in respective planes 638, 640. Each of the mating zones 634, 636 may be referred to herein as a "second" and/or a "third" mating zone. Each of the planes 638, 640 may be referred to herein as a "second" and/or a "third" plane.

The mating segment 618 of the electrical contact 502 includes the base 624, which includes the engagement surface 544 described above. The engagement surface 544 is configured to intimately engage the contact surface 526 of the electrical contact 500. Specifically, the engagement surface 544 of the base 624 defines a mating zone 642 of the electrical contact 502. The mating zone 642 is a localized area of the mating segment 618 where the engagement surface 544 intimately engages the contact surface 526 at the mating zone 542 of the electrical contact 500 to form an electrical connection between the electrical contacts 500, 502. As shown in FIG. 8, the mating zone 642 is configured to intimately engage the contact surface 526 of the electrical contact 500 in a plane 648.

Each of the mating zones 634, 636 is offset from the mating zone 642 along the length of the mating segment 618 (i.e., along the central longitudinal axis 614) in a direction $D_1$ toward the contact end 610, as is illustrated in FIG. 8. As should also be apparent from FIG. 8, the plane 648 of the mating zone 642 is oriented approximately perpendicular to each of the planes 638, 640 of the respective mating zones 634, 636. The mating zone 642 may be referred to herein as a "first" mating zone. The plane 648 may be referred to herein as a "first" plane.

In the illustrated embodiment, the contact fingers 504, 506 of the mating segment 618 of the electrical contact 502 are springs, but the contact fingers 504, 506 may have any other structure, shape, geometry, and/or the like in other embodiments. Moreover, the mating segment 618 of the electrical contact 502 may include any other structure, shape, geometry, and/or the like in addition or alternatively to the contact fingers 504, 506 in other embodiments. Although two are shown, the mating segment 618 of the electrical contact 302 may include any number of contact fingers 504, 506. For example, in some other embodiments, the mating segment 618 of the electrical contact 502 includes only a single contact finger 504 or 506. Each of the contact fingers 504, 506 may be referred to herein as a "spring finger".

As shown, the engagement surfaces 532 of the contact fingers 504, 506 face each other with a receptacle 650 therebetween, such that the mating segment 618 of the electrical contact 502 is used in operation as a receptacle that receives the plug of the mating segment 518 of the electrical contact 500 therein. But, in other embodiments the mating segment 618 of the electrical contact 502 does not define a receptacle that receives a plug therein. Moreover, although shown as being aligned and facing (i.e., shown as opposing) each other such that the engagement surfaces 532 engage opposite sides of the mating segment 518 at approximately the same location along the corresponding sides (i.e., along the central longitudinal axis 514), other relative orientations may be provided in other embodiments (e.g., the engagement surfaces 532 may not face each other, the engagement surfaces 532 of the contact fingers 504, 506 may be located at different locations along the central longitudinal axis 514, and/or the like).

Figure 9:
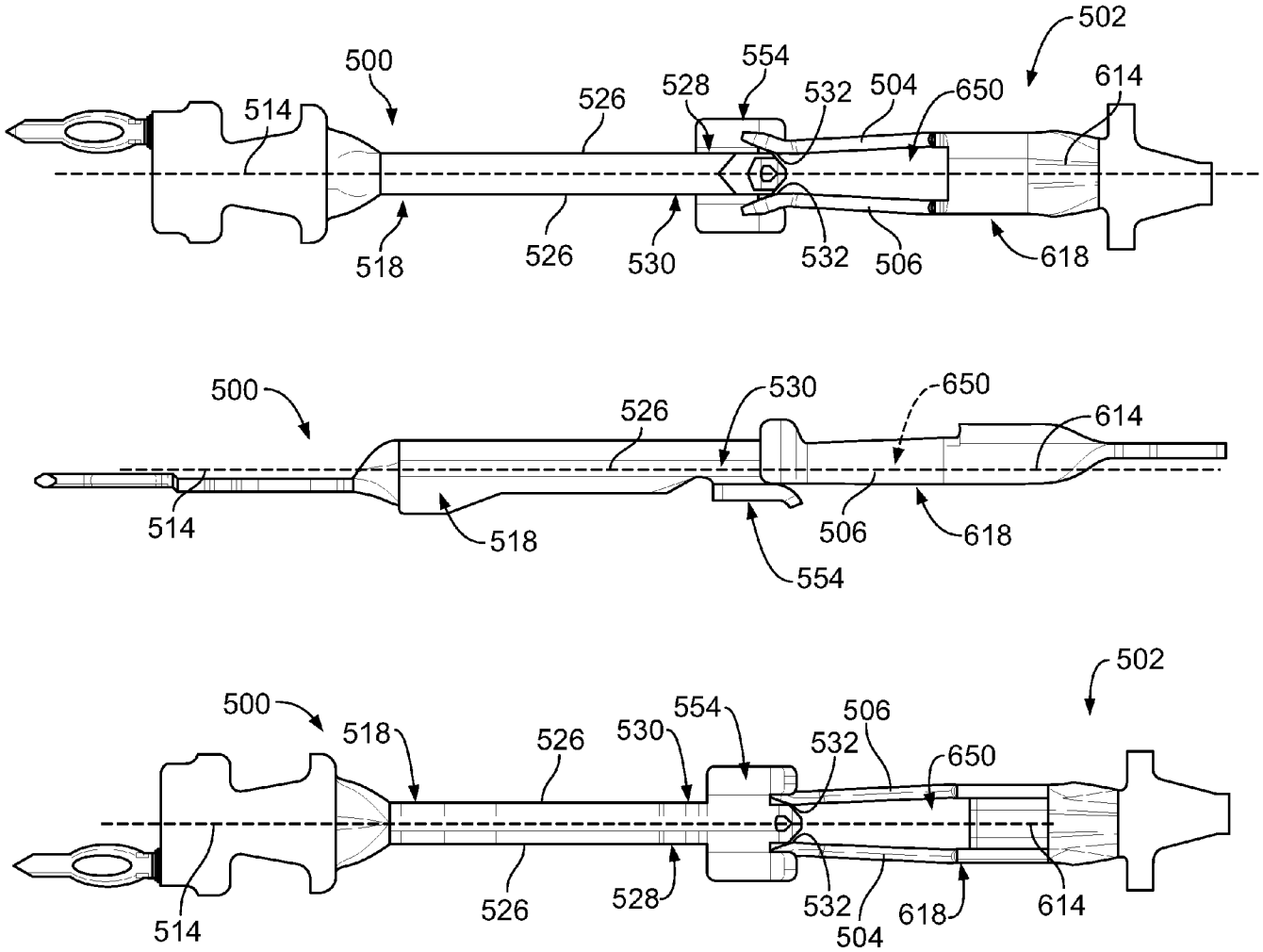
FIG. 9 is another top plan view, bottom plan view, and side elevational view of the electrical contacts shown in FIG. 8 illustrating the electrical contacts being mated with each other.

The electrical contacts 500, 502 are mated together (sometimes referred to herein as a "mating operation") by aligning the central longitudinal axes 514, 614 and moving the mating segments 518, 618 relatively together along the aligned axes 514, 614, as illustrated FIG. 9. During the mating operation, the guide 554 of the mating segment 518 engages the contact fingers 504, 506 to facilitate guiding the mating segments 518, 618 together along the aligned central longitudinal axes 514, 614. The engagement surfaces 532 of the contact fingers 504, 506 directly engage the contact surface 526 of the mating segment 518 at the first and second runways 528, 530, respectively, of the electrical contact 500, as shown in FIG. 9. In the illustrated embodiment, the contact surface 526 of the electrical contact 500 deflects the contact fingers 504, 506 radially outward relative to the central longitudinal axes 514, 614 as the contact fingers 504, 506 engage the contact surface 526, as can be seen from a comparison of FIGS. 8 and 9.

Figure 10:
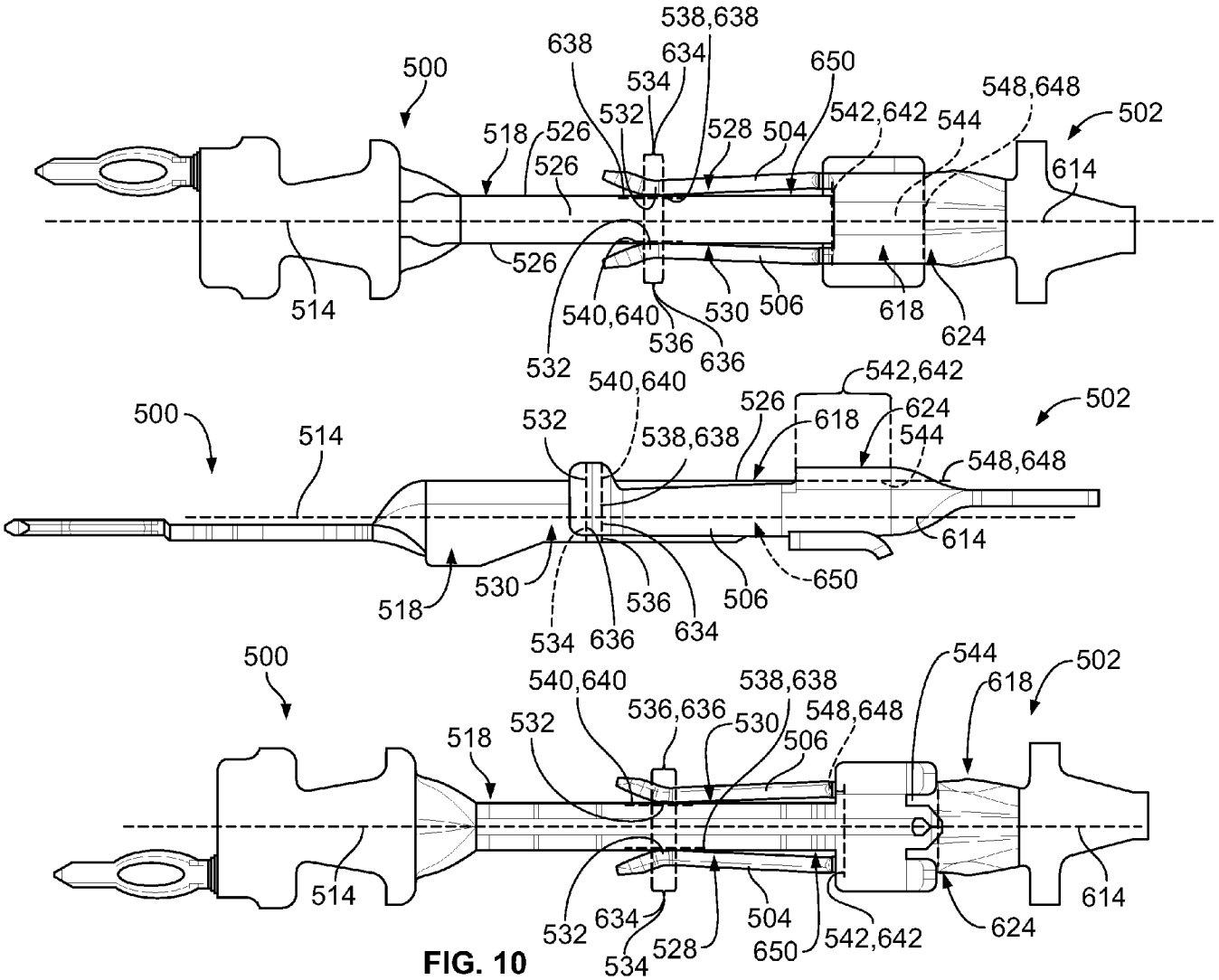
FIG. 10 is another top plan view, bottom plan view, and side elevational view illustrating the electrical contacts shown in FIGS. 8 and 9 as fully mated together.

As shown in FIG. 8-10, the mating segment 518 of the electrical contact 500 is used as a plug that is received within the receptacle 650 of the mating segment 618 of the electrical contact 502 during the mating operation. As described above, other arrangements are possible in other embodiments (e.g., embodiments wherein the mating segment 618 of the electrical contact 502 includes only a single contact finger 504 or 506).

A comparison of FIGS. 9 and 10 illustrates that the engagement surfaces 532 of the contact fingers 504, 506 slide (or wipe) along the first and second runways 528, 500, respectively, as the mating segments 518, 618 are moved further together along the aligned central longitudinal axes 514, 614 (i.e., as the mating segment 518 is received further into the receptacle 650 in the illustrated embodiment) during the mating operation.

FIG. 10 illustrates the electrical contacts 500, 502 as fully mated together. In the fully mated position, the mating segment 518 of the electrical contact 500 has been fully received into the receptacle 650 of the mating segment 618 of the electrical contact 502. The engagement surfaces 532 of the contact fingers 504, 506 have slid (or wiped) further along the first and second runways 528, 530, respectively, of the contact surface 526 into the mating zones 534, 536, respectively, of the mating segment 518. The engagement surface 532 of the contact finger 504 is intimately engaged with the contact surface 526 of the electrical contact 500 at the mating zones 534, 634. As can be seen in FIG. 10, the mating zones 534, 634 are aligned with each other when the electrical contacts 500, 502 are fully mated. Accordingly, the planes 538, 638 of the respective mating zones 534, 634 are aligned with each other when the electrical contacts 500, 502 are fully mated. Similarly, the engagement surface 532 of the contact finger 506 is intimately engaged with the contact surface 526 of the electrical contact 500 at the mating zones 536, 636. The mating zones 536, 636 are aligned with each other when the electrical contacts 500, 502 are fully mated. The planes 540, 640 of the respective mating zones 536, 636 thus are aligned with each other when the electrical contacts 500, 502 are fully mated.

As illustrated in FIG. 10, the aligned mating zones 534, 534 of the contact finger 504 extend at approximately the same location along the length of the central longitudinal axes 514, 614 as the aligned mating zones 536, 636 of the contact finger 506 when the electrical contacts 500, 502 are fully mated. Moreover, the aligned planes 538, 638 of the contact finger 504 extend approximately parallel to the aligned planes 540, 640 of the contact finger 506 when the electrical contacts 500, 502 are fully mated. In some alternative embodiments, the aligned mating zones 534, 634 of the contact finger 504 extend at a different location along the length of the central longitudinal axes 514, 614 than the aligned mating zones 536, 636 of the contact finger 506 when the electrical contacts 500, 502 are fully mated.

The engagement surface 544 of the base 624 of the mating segment 618 is intimately engaged with the contact surface 526 of the electrical contact 500 at the mating zones 542, 642. As can be seen in FIG. 10, the mating zones 542, 642 are aligned with each other when the electrical contacts 500, 502 are fully mated. Accordingly, and as illustrated in FIG. 10, the planes 548, 648 of the respective mating zones 542, 642 are aligned with each other when the electrical contacts 500, 502 are fully mated. In the illustrated embodiment, the engagement surface 544 of the base 624 of the mating segment 618 deflects the mating segment 518 as the base 624 engages the mating segment 518. In addition or alternatively, the base 624 includes a spring at the mating zone 642.

FIG. 10 illustrates that the aligned mating zones 542, 642 of the base 624 are offset from the aligned mating zones 534, 634 of the contact finger 504 along the length of the central longitudinal axes 514, 614. As is also shown in FIG. 10, the aligned mating zones 542, 642 of the base 624 are offset from the aligned mating zones 536, 636 of the contact finger 506 along the length of the central longitudinal axes 514, 614. FIG. 10 also illustrates that the aligned planes 548, 648 of the base 624 extend approximately perpendicular to the aligned planes 538, 638 of the contact finger 504; and that the aligned planes 548, 648 of the base 624 extend approximately perpendicular to the aligned planes 540, 640 of the contact finger 506. Accordingly, the electrical contacts 500, 502 mate together at at least two points of engagement (i.e., contact) that are offset from each other along the length of the mated electrical contacts 500, 502 and that extend in approximately perpendicular planes.

When the contact fingers 504, 506 are in deflected conditions as shown in FIG. 10, each of the contact fingers 504, 506 may generate a normal force that presses the corresponding engagement surface 532 against the contact surface 526 of the mating segment 518 such that a sufficient electrical connection is made between the contact finger 504, 506 and the mating segment 518. Similarly, the mating segment 518 may generate a normal force that presses the engagement surface 544 against the contact surface 526 of the mating segment 518 such that a sufficient electrical connection is made between the base 624 of the mating segment 618 and the mating segment 518 when the mating segment 518 is in deflected condition as shown in FIG. 10. Each of the contact fingers 504, 506 and the mating segment 518 may be configured (e.g., sized, shaped, and/or the like) to generate a normal force of a designated value when in the deflected condition.

In the illustrated embodiment of the electrical contacts 500, 502, no stub portion of the mating segment 518 of the electrical contact 500 is formed when the electrical contacts 500, 502 are mated together. Specifically, the mating segment 518 does not include a stub portion because the mating zones 542, 642 extend at the contact end 510 of the mating segment 518 of the electrical contact 500.

The electrical contacts 500, 502 may reduce unwanted effects of reflected energy along a stub portion by eliminating the stub portion, as is described above. By eliminating a stub portion, the electrical contacts 500, 502 may reduce the amount of energy that is resonated from the mating segment 518 such that less electromagnetic radiation permeates the interface between the mated electrical contacts 500, 502, which may, for example, reduce electromagnetic interference (EMI) such as, but not limited to, crosstalk and/or the like. In some embodiments, eliminating a stub portion prevents the mating segment 518 from acting as an antenna.

By reducing the amount of electromagnetic radiation that permeates the interface between the mated electrical contacts 500, 502, the electrical contacts 500, 502 may require less electromagnetic shielding, which may reduce the cost of manufacturing an electrical connector system (e.g., the system 100 shown in FIG. 1) that includes the electrical contacts 500, 502.

It should be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled.

As used in the description, the phrase "in an exemplary embodiment" and/or the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. An electrical contact comprising:

a mating segment configured to engage another contact, the mating segment extending a length to a contact end of the mating segment, wherein the mating segment comprises:

a first mating zone that is located a distance from the contact end along the length of the mating segment, the first mating zone configured to intimately engage the other contact in a first plane for electrical communication between the electrical contact and the other contact; and a second mating zone that is offset from the first mating zone along the length of the mating segment in a direction toward the contact end, wherein the second mating zone is configured to intimately engage the other contact in a second plane that extends approximately perpendicular to the first plane for electrical communication between the electrical contact and the other contact.

2. The electrical contact of claim 1, wherein the mating segment further comprises a third mating zone that is configured to intimately engage the other contact in a third plane that extends approximately parallel to the first plane or the second plane for electrical communication between the electrical contact and the other contact.

3. The electrical contact of claim 1, wherein the mating segment extends the length along a central longitudinal axis, the mating segment further comprising a third mating zone that is configured to intimately engage the other contact in approximately the same location along the central longitudinal axis as the first mating zone or the second mating zone for electrical communication between the electrical contact and the other contact.

4. The electrical contact of claim 1, wherein the distance that the first mating zone is located from the contact end is a first distance, the second mating zone located a second distance from the contact end that is less than the first distance.

5. The electrical contact of claim 1, wherein the second mating zone is located along the length of the mating segment approximately at the contact end of the mating segment.

6. The electrical contact of claim 1, wherein the second mating zone is located along the length of the mating segment at an intermediate location between the first mating zone and the contact end.

7. The electrical contact of claim 1, wherein the mating segment includes a base and a spring finger that extends outward from the base, the spring finger comprising the second mating zone and the contact end of the mating segment, the mating segment further comprising a contact tab that extends from the base and comprises the first mating zone.

8. The electrical contact of claim 1, wherein the mating segment includes a base and a spring finger that extends outward from the base, the spring finger comprising the second mating zone and the contact end of the mating segment, the base of the mating segment comprising the first mating zone.

9. The electrical contact of claim 1, wherein the mating segment comprises a post, a pin, or a blade.

10. The electrical contact of claim 1, wherein the mating segment comprises a guide that is configured to guide the other contact during a mating operation.

11. The electrical contact of claim 1, wherein the mating segment comprises a contact surface that defines a wipe runway located between the contact end and the first mating zone, the other contact configured to slide along the wipe runway during a mating operation.

12. The electrical contact of claim 1, wherein the mating segment defines a plug or a receptacle.

13. An electrical contact comprising:

a mating segment configured to engage another contact, the mating segment extending a length to a contact end of the mating segment, wherein the mating segment comprises:

a base;

a first mating zone located a distance from the contact end along the length of the mating segment, the first mating zone configured to intimately engage the other contact in a first plane for electrical communication between the electrical contact and the other contact; and a spring finger extending outward from the base and defining at least a portion of the contact end of the mating segment, the spring finger comprising a second mating zone that is located approximately at the contact end such that the second mating zone is offset from the first mating zone along the length of the mating segment, wherein the second mating zone is configured to intimately engage the other contact in a second plane that extends approximately perpendicular to the first plane for electrical communication between the electrical contact and the other contact.

14. The electrical contact of claim 13, wherein the mating segment comprises a contact tab that extends from the base and includes the first mating zone.

15. The electrical contact of claim 13, wherein the base of the mating segment comprises the first mating zone.

16. The electrical contact of claim 13, wherein the spring finger is a first spring finger and the mating segment further comprises a second spring finger that extends outward from the base, the second spring finger comprising a third mating zone that is configured to intimately engage the other contact in a third plane that extends approximately parallel to the second plane for electrical communication between the electrical contact and the other contact.

17. The electrical contact of claim 13, wherein the spring finger is a first spring finger and the mating segment extends the length along a central longitudinal axis, the mating segment further comprises a second spring finger that extends outward from the base and defines a portion of the contact end of the mating segment, the second spring finger comprising a third mating zone that is configured to intimately engage the other contact in approximately the same location along the central longitudinal axis as the second mating zone for electrical communication between the electrical contact and the other contact.

18. The electrical contact of claim 13, wherein the mating segment defines a receptacle.

19. An electrical connector comprising:

a connector housing configured to engage another connector; and a contact array including a plurality of electrical contacts coupled to the connector housing, each of the electrical contacts including a contact body having a mating segment and a base segment, the base segment being coupled to the connector housing, the mating segment configured to engage another contact of the other connector, the mating segment extending a length to a contact end of the mating segment, wherein the mating segment comprises:

a first mating zone that is located a distance from the contact end along the length of the mating segment, the first mating zone configured to intimately engage the other contact in a first plane for electrical communication between the electrical contact and the other contact; and a second mating zone that is offset from the first mating zone along the length of the mating segment in a direction toward the contact end, wherein the second mating zone is configured to intimately engage the other contact in a second plane that extends approximately perpendicular to the first plane for electrical communication between the electrical contact and the other contact.

20. The electrical connector of claim 19, wherein the second mating zone is located along the length of the mating segment approximately at the contact end of the mating segment.

* * * * *